US010629132B2

(12) United States Patent
Kim et al.

(10) Patent No.: US 10,629,132 B2
(45) Date of Patent: Apr. 21, 2020

(54) DISPLAY DEVICE AND ELECTRONIC DEVICE INCLUDING A PLURALITY OF SEPARATELY DRIVEN DISPLAY AREAS AND DISPLAY CONTROL METHOD FOR CONTROLLING THE SAME

(71) Applicant: Samsung Electronics Co., Ltd., Gyeonggi-do (KR)

(72) Inventors: Taesung Kim, Gyeonggi-do (KR); Donghui Kim, Gyeonggi-do (KR); Jong-Kon Bae, Seoul (KR); Dongkyoon Han, Gyeonggi-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 0 days.

(21) Appl. No.: 15/775,873

(22) PCT Filed: Nov. 11, 2016

(86) PCT No.: PCT/KR2016/013020
§ 371 (c)(1),
(2) Date: May 14, 2018

(87) PCT Pub. No.: WO2017/082685
PCT Pub. Date: May 18, 2017

(65) Prior Publication Data

US 2018/0330671 A1 Nov. 15, 2018

(30) Foreign Application Priority Data

Nov. 13, 2015 (KR) ..... 10-2015-0159712

(51) Int. Cl.
*G09G 3/3266* (2016.01)
*G09G 3/3225* (2016.01)
*G09G 3/3275* (2016.01)

(52) U.S. Cl.
CPC ..... *G09G 3/3266* (2013.01); *G09G 3/3225* (2013.01); *G09G 3/3275* (2013.01);
(Continued)

(58) Field of Classification Search
CPC ..... G09G 3/3266; G09G 3/3233; G09G 2330/027; G09G 2330/021;
(Continued)

(56) References Cited

U.S. PATENT DOCUMENTS 6,788,277 B2 9/2004 Kanauchi et al.
2004/0155848 A1 8/2004 Kudo et al.
(Continued)

FOREIGN PATENT DOCUMENTS

EP 1 755 103 A1 2/2007
EP 2 693 319 A2 2/2014
(Continued)

OTHER PUBLICATIONS

European Search Report dated Oct. 25, 2018.
European Search Report dated Aug. 1, 2018.
European Search Report dated Jul. 25, 2019.

*Primary Examiner* — Darlene M Ritchie
(74) *Attorney, Agent, or Firm* — Cha & Reiter, LLC.

(57) ABSTRACT

Provided in various examples are a device and a method, the device comprising: a first pixel group and a second pixel group for converting an electrical signal into an optical signal; a first emission line for transmitting, to the first pixel group, power supplied from the outside; and a second emission line for transmitting the power to the second pixel group, wherein the first emission line and the second emission line are electrically separated from each other. In addition, other examples are also possible.

19 Claims, 15 Drawing Sheets

(52) U.S. Cl.
CPC ..... *G09G 2300/0842* (2013.01); *G09G 2300/0861* (2013.01); *G09G 2310/0221* (2013.01); *G09G 2310/0232* (2013.01); *G09G 2320/0686* (2013.01); *G09G 2330/021* (2013.01); *G09G 2330/027* (2013.01)

(58) Field of Classification Search
CPC ... G09G 2320/0686; G09G 2310/0232; G09G 2310/0221; G09G 2300/0861; G09G 2300/0842; G09G 3/3225
See application file for complete search history.

(56) References Cited

U.S. PATENT DOCUMENTS

2005/0007319 A1* 1/2005 Shin ..... G09G 3/3241 345/76
2005/0057191 A1 3/2005 Jo et al.
2005/0264496 A1* 12/2005 Shin ..... G09G 3/3233 345/76
2007/0035485 A1 2/2007 Yoon
2007/0046884 A1 3/2007 An et al.
2009/0033601 A1* 2/2009 Lee ..... G09G 3/3233 345/77
2009/0284500 A1* 11/2009 Yamashita ..... G09G 3/3666 345/204
2010/0060548 A1* 3/2010 Choi ..... G06F 3/0414 345/1.3
2010/0149218 A1 6/2010 Betts-LaCroix
2010/0201675 A1* 8/2010 Kuranaga ..... G09G 3/325 345/211
2012/0105496 A1* 5/2012 Komiya ..... G09G 3/003 345/690
2012/0212517 A1* 8/2012 Ahn ..... G11C 19/28 345/690
2013/0021231 A1* 1/2013 Kawashima ..... G09G 3/3666 345/98
2013/0222437 A1* 8/2013 Ka ..... G09G 3/3233 345/690
2014/0028596 A1* 1/2014 Seo ..... G06F 3/0487 345/173
2014/0063392 A1* 3/2014 Gondo ..... G09G 3/3611 349/41
2014/0152707 A1* 6/2014 Numata ..... G09G 3/3233 345/690
2014/0368479 A1 12/2014 Bae et al.
2015/0054800 A1 2/2015 Kim et al.
2015/0179112 A1* 6/2015 Yamazaki ..... G09G 3/3406 345/690
2015/0364396 A1* 12/2015 Asai ..... G02F 1/13336 257/43
2016/0293079 A1 10/2016 Kim et al.
2017/0148419 A1* 5/2017 Zhang ..... G09F 9/301

FOREIGN PATENT DOCUMENTS

EP 2 927 901 A2 10/2015
JP 2004-240235 A 8/2004
JP 2007-58215 A 3/2007
JP 2007-219048 A 8/2007
JP 2008-107378 A 5/2008
JP 2009-276547 A 11/2009
KR 10-2008-0086746 A 9/2008
KR 10-1111959 B1 1/2012
KR 10-2013-0025228 A 3/2013
KR 10-2014-0145338 A 12/2014
KR 10-2015-0024073 A 3/2015
KR 10-2015-0029182 A 3/2015
KR 10-2016-0117758 A 10/2016

* cited by examiner

DISPLAY DEVICE AND ELECTRONIC DEVICE INCLUDING A PLURALITY OF SEPARATELY DRIVEN DISPLAY AREAS AND DISPLAY CONTROL METHOD FOR CONTROLLING THE SAME

CLAIM OF PRIORITY

This application is a National Phase Entry of PCT International Application No. PCT/KR2016/013020, which was filed on Nov. 11, 2016 and claims a priority to Korean Patent Application No. 10-2015-0159712, which was filed on Nov. 13, 2015, the contents of which are incorporated herein by reference.

TECHNICAL FIELD

Various embodiments relate to a display control method, a display in which the same is implemented, a display device, and an electronic device.

BACKGROUND ART

With the recent development of digital technologies, various types of electronic devices such as mobile communication terminals, smart phones, tablet Personal Computers (PC), Personal Digital Assistants (PDA), electronic notes, notebooks, wearable devices, and televisions (TV) are widely used. In such electronic devices, a display area is not only on the front surface of an electronic device but also extends to the right and left side surfaces of the electronic device. For example, when a bent display is applied to an electronic device, the right and left edge parts of the display may be bent to make a screen look larger.

DETAILED DESCRIPTION OF THE INVENTION

Technical Problem

An electronic device may operate by dividing the entire display area into a main area and a sub-area. In this electronic device, when any processing for the sub-area is added, a processor may process an image via image processing for the sub-area. The processor performs image processing for the entire display area (e.g., the main area and the sub-area) even when performing image processing for the sub-area. In this case, although current consumption for the sub-area is lower than current consumption for the main area, as the processor consumes current for the entire display area, the overall current consumption of the electronic device may increase.

Various embodiments may provide a method and a device for dividing a display area of an electronic device into two or more display areas, and separating an emission driver between the divided display areas in terms of hardware, thereby independently controlling each display area.

Technical Solution

A display panel according to various embodiments may include: a first pixel group and a second pixel group for converting an electrical signal into an optical signal; a first emission line for transferring power supplied from the outside to the first pixel group; and a second emission line for transferring the power to the second pixel group, wherein the first emission line and the second emission line may be electrically separated from each other.

A display device according to various embodiments may include: a display panel including a first display area corresponding to the first pixel group and a second display area corresponding to the second pixel group; and a display driver circuit for controlling the display panel, wherein the display driver circuit includes a first emission control circuit for controlling power supply to at least some pixels of the first pixel group and a second emission control circuit for controlling power supply to at least some pixels of the second pixel group.

An electronic device according to various embodiments may include: a processor; a communication module; and a display functionally connected with the communication module, wherein the display includes: a display panel including a first display area corresponding to a first pixel group and a second display area corresponding to a second pixel group; and a display driver circuit for controlling the display panel, and the display driver circuit includes a first emission control circuit for controlling power supply to at least some pixels of the first pixel group and a second emission control circuit for controlling power supply to at least some pixels of the second pixel group.

A display control method of an electronic device according to various embodiments, the electronic device including a display device that includes a display driver circuit including: a first emission control circuit for controlling power supply to at least some pixels of a first display area corresponding to a first pixel group of a display panel; and a second emission control circuit that controls power supply to at least some pixels of a second display area corresponding to a second pixel group of the display panel, and can be controlled independently of the first emission control circuit, may include: receiving a request for outputting a content; at least on the basis of the request, displaying at least a part of the content through the first display area by using the first emission control circuit; at least on the basis of displaying of at least the part of the content, refraining from supplying power to the at least some pixels of the second display area, by using the second emission control circuit.

A computer-readable recording medium according to various embodiments may include a program for performing: receiving a request for outputting a content; on the basis of the request, displaying at least a part of the content through the first display area by using the first emission control circuit; and at least on the basis of displaying of at least the part of the content, refraining from supplying power to the at least some pixels of the second display area, by using the second emission control circuit.

Advantageous Effects

According to various embodiments, a display area of an electronic device is divided into two or more display areas, emission control circuits between the divided display areas are separated in terms of hardware, and each of the display areas can be thus independently controlled.

According to various embodiments, a partial display function can be provided by separating a control driver between the display areas in terms of hardware.

According to various embodiments, the display areas can be partially driven as need, and power of the electronic device can be thus saved.

According to various embodiments, current consumption of a battery can be reduced in the case of partially driving the display area compared with driving the entire display area.

MODE FOR CARRYING OUT THE INVENTION

Figure 1:
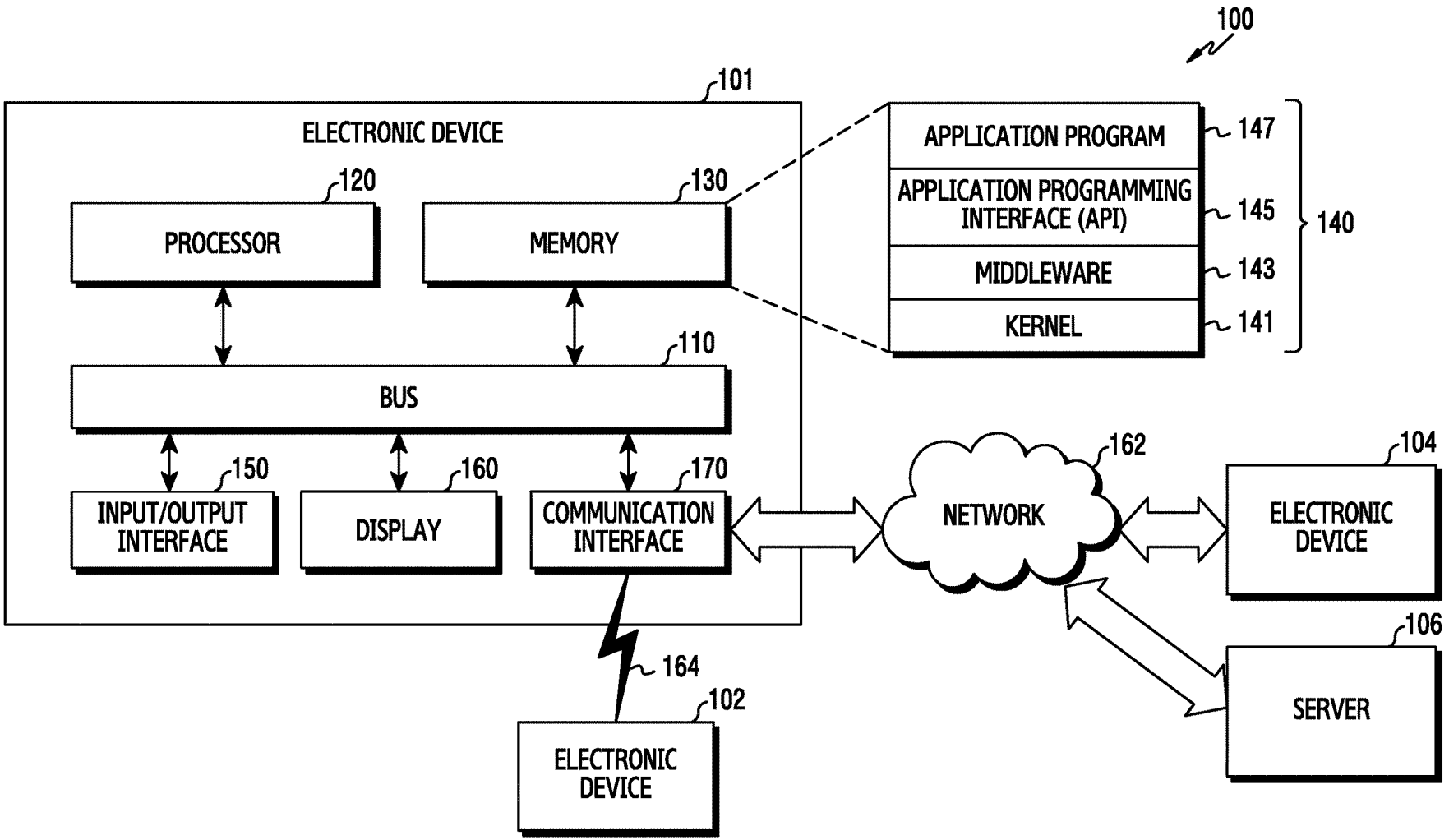
FIG. 1 is a diagram illustrating an electronic device within a network environment according to various embodiments.

Hereinafter, various embodiments of the present disclosure will be described with reference to the accompanying drawings. The embodiments and the terms used therein are not intended to limit the technology disclosed herein to specific forms, and should be understood to include various modifications, equivalents, and/or alternatives to the corresponding embodiments. In the description of the drawings, similar reference numerals may be used to designate similar elements. As used herein, singular forms may include plural forms as well unless the context clearly indicates otherwise.

In the present disclosure, the expression "A or B", "at least one of A and/or B", or "A/B" may include all possible combinations of the items listed. The expression "a first", "a second", "the first", or "the second" may modify corresponding elements regardless of the order or importance, and is used only to distinguish one element from another element, but does not limit the corresponding elements. When an element (e.g., first element) is referred to as being "(functionally or communicatively) connected," or "directly coupled" to another element (second element), the element may be connected directly to the another element or connected to the another element through yet another element (e.g., third element).

The expression "configured to" as used in various embodiments of the present disclosure may be interchangeably used with, for example, "suitable for", "having the capacity to", "designed to", "adapted to", "made to", or "capable of" in terms of hardware or software, according to circumstances. Alternatively, in some situations, the expression "device configured to" may mean that the device, together with other devices or components, "is able to". For example, the phrase "processor adapted (or configured) to perform A, B, and C" may mean a dedicated processor (e.g. embedded processor) only for performing the corresponding operations or a generic-purpose processor (e.g., central processing unit (CPU) or application processor (AP)) that can perform the corresponding operations by executing one or more software programs stored in a memory device.

An electronic device according to various embodiments of the present disclosure may include at least one of, for example, a smart phone, a tablet Personal Computer (PC), a mobile phone, a video phone, an electronic book reader (e-book reader), a desktop PC, a laptop PC, a netbook computer, a workstation, a server, a Personal Digital Assistant (PDA), a Portable Multimedia Player (PMP), a MPEG-1 audio layer-3 (MP3) player, a mobile medical device, a camera, and a wearable device. According to various embodiments, the wearable device may include at least one of an accessory type (e.g., a watch, a ring, a bracelet, an anklet, a necklace, a glasses, a contact lens, or a Head-Mounted Device (HMD)), a fabric or clothing integrated type (e.g., an electronic clothing), a body-mounted type (e.g., a skin pad, or tattoo), and a bio-implantable type (e.g., an implantable circuit). In some embodiments, the electronic device may include at least one of, for example, a television, a Digital Video Disk (DVD) player, an audio, a refrigerator, an air conditioner, a vacuum cleaner, an oven, a microwave oven, a washing machine, an air cleaner, a set-top box, a home automation control panel, a security control panel, a TV box (e.g., Samsung HomeSync™, Apple TV™, or Google TV™), a game console (e.g., Xbox™ and PlayStation™), an electronic dictionary, an electronic key, a camcorder, and an electronic photo frame.

In other embodiments, the electronic device may include at least one of various medical devices (e.g., various portable medical measuring devices (a blood glucose monitoring device, a heart rate monitoring device, a blood pressure measuring device, a body temperature measuring device, etc.), a Magnetic Resonance Angiography (MRA), a Magnetic Resonance Imaging (MRI), a Computed Tomography (CT) machine, and an ultrasonic machine), a navigation device, a Global Positioning System (GPS) receiver, an Event Data Recorder (EDR), a Flight Data Recorder (FDR), a Vehicle Infotainment Devices, an electronic devices for a ship (e.g., a navigation device for a ship, and a gyrocompass), avionics, security devices, an automotive head unit, a robot for home or industry, an automatic teller's machine (ATM) in banks, point of sales (POS) in a shop, or internet device of things (e.g., a light bulb, various sensors, electric or gas meter, a sprinkler device, a fire alarm, a thermostat, a streetlamp, a toaster, a sporting goods, a hot water tank, a heater, a boiler, etc.). According to some embodiments, an electronic device may include at least one of a part of furniture or a building/structure, an electronic board, an electronic signature receiving device, a projector, and various types of measuring instruments (e.g., a water meter, an electric meter, a gas meter, a radio wave meter, and the like). In various embodiments, the electronic device may be flexible, or may be a combination of one or more of the aforementioned various devices. The electronic device according to one embodiment of the present disclosure is not limited to the above described devices. In the present disclosure, the term "user" may indicate a person using an electronic device or a device (e.g., an artificial intelligence electronic device) using an electronic device.

With reference to FIG. 1, an electronic device 101 within a network environment 100, according to various embodiments, will be described.

The electronic device 101 may include a bus 110, a processor 120, a memory 130, an input/output interface 150, a display 160, and a communication circuit 170. In some embodiments, the electronic device 101 may omit at least one of the elements, or may further include other elements.

The bus 110 may include, for example, a circuit that interconnects the elements 110 to 170 and transfers communication (e.g., control messages and/or data) between the elements.

The processor 120 may include one or more of a central processing unit, an application processor, and a communication processor (CP). For example, the processor 120 may carry out operations or data processing relating to the control and/or communication of at least one other element of the electronic device 101.

The memory 130 may include a volatile memory and/or a non-volatile memory. The memory 130 may store, for example, instructions or data relating to at least one other element of the electronic device 101. According to an embodiment, the memory 130 may store software and/or a program 140. The program 140 may include, for example, a kernel 141, middleware 143, an application programming interface (API) 145, and/or application programs (or "applications") 147.

At least a part of the kernel 141, the middleware 143, or the API 145 may be referred to as an Operating System (OS). For example, the kernel 141 may control or manage system resources (e.g., the bus 110, the processor 120, the memory 130, etc.) that are used to execute operations or functions implemented in the other programs (e.g., the middleware 143, the API 145, and the application programs 147). Furthermore, the kernel 141 may provide an interface through which the middleware 143, the API 145, or the application programs 147 may access the individual elements of the electronic device 101 to control or manage the system resources.

The middleware 143 may function, for example, as an intermediary for allowing the API 145 or the application programs 147 to communicate with the kernel 141 to exchange data. In addition, the middleware 143 may process one or more task requests received from the application programs 147 according to priorities thereof. For example, the middleware 143 may assign priorities for using the system resources (e.g., the bus 110, the processor 120, the memory 130, etc.) of the electronic device 101 to one or more of the application programs 147, and may process the one or more task requests.

The API 145 is an interface used by the applications 147 to control a function provided from the kernel 141 or the middleware 143, and may include, for example, at least one interface or function (e.g., instruction) for file control, window control, image processing, text control, etc. For example, the input/output interface 150 may forward instructions or data, which is input from a user or an external device, to the other element(s) of the electronic device 101, or may output instructions or data, which is received from the other element(s) of the electronic device 101, to the user or the external device.

The display 160 may include, for example, a liquid crystal display (LCD), a light emitting diode (LED) display, an organic light emitting diode (OLED) display, a micro electro mechanical system (MEMS) display, or an electronic paper display. The display 160 may display, for example, various types of content (e.g., text, images, videos, icons, and/or symbols) for a user. The display 160 may include a touch screen and may receive, for example, a touch input, a gesture input, a proximity input, or a hovering input using an electronic pen or a user's body part.

The communication interface 170 may configure, for example, communication between the electronic device 101 and an external device (e.g., a first external electronic device 102, a second external electronic device 104, or a server 106). For example, the communication interface 170 may be connected to a network 162 through wireless or wired communication to communicate with the external device (e.g., the second external device 104 or the server 106).

The wireless communication may include, for example, a cellular communication that uses at least one of LTE, LTE-Advance (LTE-A), code division multiple access (CDMA), wideband CDMA (WCDMA), universal mobile telecommunications system (UMTS), wireless broadband (WiBro), global system for mobile communications (GSM), etc. According to an embodiment, the wireless communication may include, for example, at least one of WiFi, Bluetooth, Bluetooth low energy (BLE), Zigbee, near field communication (NFC), magnetic secure transmission, radio frequency, and body area network (BAN).

According to an embodiment, the wired communication may include GNSS. The GNSS may be, for example, a global positioning system (GPS), a global navigation satellite system (Glonass), a Beidou navigation satellite system (hereinafter, referred to as "Beidou"), or Galileo (the European global satellite-based navigation system). Hereinafter, the term "GPS" may be interchangeably used with the term "GNSS" in the present disclosure. The wired communication may include, for example, at least one of a universal serial bus (USB), a high definition multimedia interface (HDMI), recommended standard 232 (RS-232), and a plain old telephone service (POTS). The network 162 may include a telecommunications network, which may be, for example, at least one of a computer network (e.g., a LAN or a WAN), the Internet, and a telephone network.

The first and second external electronic devices 102 and 104 may be the same type as, or a different type than, the electronic device 101. According to various embodiments, all or some of the operations performed in the electronic device 101 may be performed in another electronic device or in a plurality of electronic devices (e.g., the electronic devices 102 and 104 or the server 106). According to an embodiment, in a case where the electronic device 101 has to perform some functions or services automatically or in response to a request, the electronic device 101 may request another device (e.g., the electronic device 102 or 104 or the server 106) to perform at least some functions relating thereto instead of, or in addition to, performing the functions or services by itself. The other electronic device (e.g., the electronic device 102 or 104, or the server 106) may execute the requested functions or the additional functions and may deliver the execution result to the electronic device 101. The electronic device 101 may process the received result as it is or additionally to provide the requested functions or services. To achieve this, for example, cloud computing, distributed computing, or client-server computing technology may be used.

Figure 2:
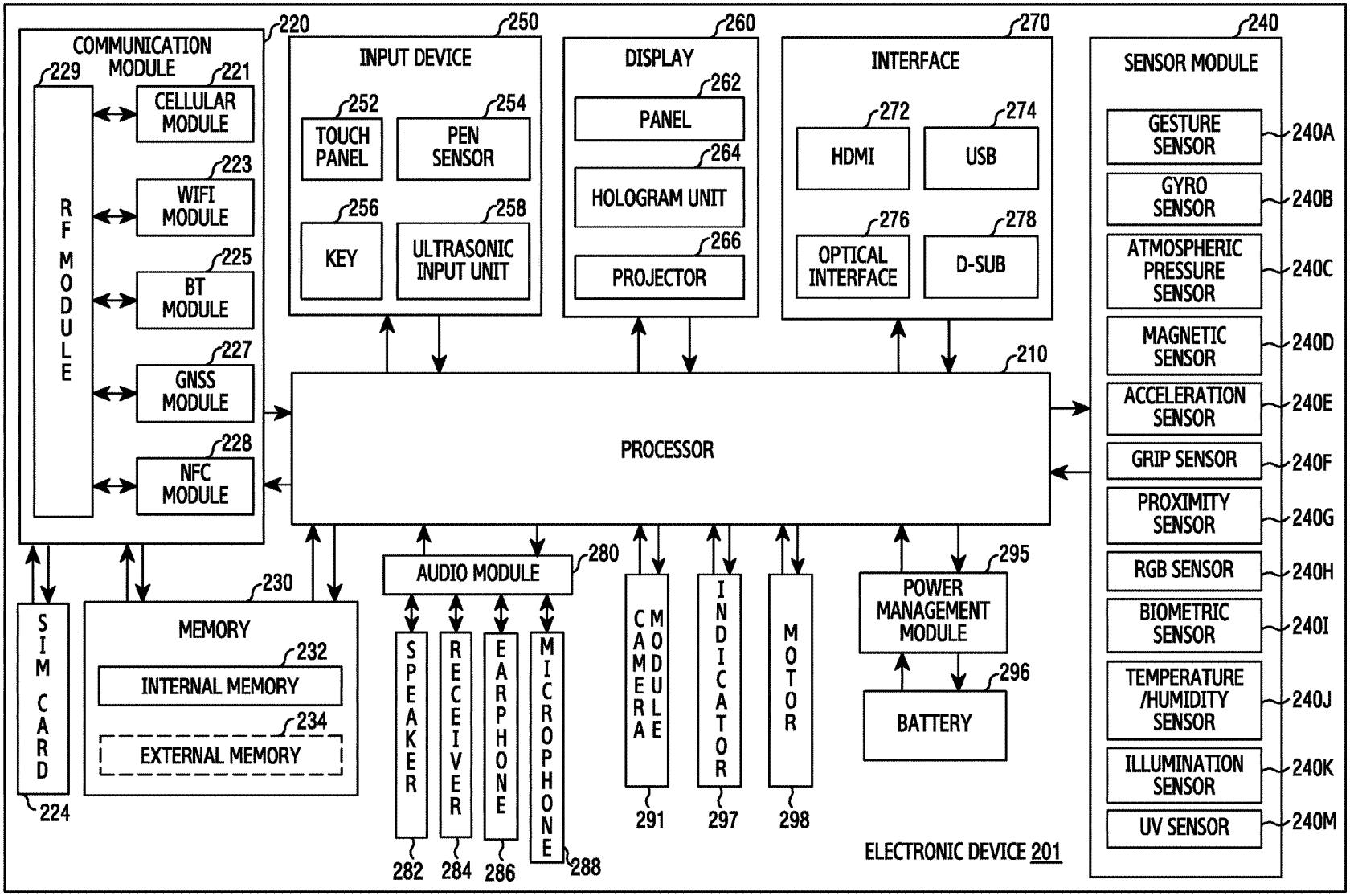
FIG. 2 is a block diagram illustrating a configuration of an electronic device according to various embodiments.

FIG. 2 is a block diagram of an electronic device 201 according to various embodiments of the present disclosure. The electronic device 201 may include, for example, the entirety, or a part, of the electronic device 101 illustrated in FIG. 1.

The electronic device 201 may include at least one processor 210 (e.g., an AP), a communication module 220, a subscriber identification module 224, a memory 230, a sensor module 240, an input device 250, a display 260, an interface 270, an audio module 280, a camera module 291, a power management module 295, a battery 296, an indicator 297, and a motor 298. The processor 210 may, for example, control a plurality of hardware or software elements connected thereto and perform various types of data processing and operations by driving an operating system or an application program.

The processor 210 may be implemented as, for example, a System on Chip (SoC). According to an embodiment, the processor 210 may further include a graphic processing unit (GPU) and/or an image signal processor. The processor 210 may include at least some (e.g., a cellular module 221) of the elements illustrated in FIG. 2. The processor 210 may load, in a volatile memory, instructions or data received from at least one of the other elements (e.g., a non-volatile memory), process the loaded instructions or data, and store the result data in the non-volatile memory.

The communication module 220 may have a configuration that is the same as, or similar to, that of the communication interface 170. The communication module 220 may include, for example, a cellular module 221, a WiFi module 223, a Bluetooth module 225, a GNSS module 227, an NFC module 228, and an RF module 229. The cellular module 221 may provide, for example, a voice call, a video call, a text message service, an Internet service, etc. through a communication network.

According to an embodiment, the cellular module 221 may identify and authenticate the electronic device 201 within a communication network using the subscriber identification module 224 (e.g., a SIM card). According to an embodiment, the cellular module 221 may perform at least some of the functions that the processor 210 may provide. According to an embodiment, the cellular module 221 may include a communication processor (CP). According to some embodiments, at least some (two or more) of the cellular module 221, the WiFi module 223, the Bluetooth module 225, the GNSS module 227, and the NFC module 228 may be included in one integrated chip (IC) or IC package. The RF module 229 may transmit/receive, for example, a communication signal (e.g., an RF signal). The RF module 229 may include, for example, a transceiver, a power amp module (PAM), a frequency filter, a low noise amplifier (LNA), an antenna, etc. According to another embodiment, at least one of the cellular module 221, the WiFi module 223, the Bluetooth module 225, the GNSS module 227, and the NFC module 228 may transmit/receive an RF signal through a separate RF module. The subscriber identification module 224 may include, for example, a card that includes a subscriber identification module, or an embedded SIM, and may contain unique identification information (e.g., an integrated circuit card identifier (ICCID)) or subscriber information (e.g., international mobile subscriber identity (IMSI)).

The memory 230 (e.g., the memory 130) may include, for example, an internal memory 232 or an external memory 234. The internal memory 232 may include, for example, at least one of a volatile memory (e.g., a DRAM, an SRAM, an SDRAM, etc.) and a non-volatile memory (e.g., a one time programmable ROM (OTPROM), a PROM, an EPROM, an EEPROM, a mask ROM, a flash ROM, a flash memory, a hard disc drive, or a solid state drive (SSD)). The external memory 234 may include a flash drive, for example, a compact flash (CF), a secure digital (SD), a Micro-SD, a Mini-SD, an eXtreme digital (xD), a multi-media card (MMC), a memory stick, etc. The external memory 234 may be functionally or physically connected to the electronic device 201 through various interfaces.

The sensor module 240 may, for example, measure a physical quantity or detect the operating state of the electronic device 201 and may convert the measured or detected information into an electrical signal. The sensor module 240 may include, for example, at least one of a gesture sensor 240A, a gyro sensor 240B, an atmospheric pressure sensor 240C, a magnetic sensor 240D, an acceleration sensor 240E, a grip sensor 240F, a proximity sensor 240G, a color sensor 240H (e.g., a red, green, blue (RGB) sensor), a biometric sensor 240I, a temperature/humidity sensor 240J, an illumination sensor 240K, and a ultraviolet (UV) sensor 240M.

Additionally or alternatively, the sensor module 240 may include, for example, an e-nose sensor, an electromyography (EMG) sensor, an electroencephalogram (EEG) sensor, an electrocardiogram (ECG) sensor, an infrared (IR) sensor, an iris sensor, and/or a fingerprint sensor. The sensor module 240 may further include a control circuit for controlling one or more sensors included therein. In some embodiments, the electronic device 201 may further include a processor configured to control the sensor module 240 as a part of, or separately from, the processor 210 and may control the sensor module 240 while the processor 210 is in a sleep state.

The input device 250 may include, for example, a touch panel 252, a (digital) pen sensor 254, a key 256, or an ultrasonic input device 258. The touch panel 252 may use, for example, at least one of a capacitive type, a resistive type, an infrared type, and an ultrasonic type. Furthermore, the touch panel 252 may further include a control circuit. The touch panel 252 may further include a tactile layer to provide a tactile reaction to a user. The (digital) pen sensor 254 may include, for example, a recognition sheet that is a part of, or separate from, the touch panel. The key 256 may include, for example, a physical button, an optical key, or a keypad. The ultrasonic input device 258 may detect ultrasonic waves, which are generated by an input tool, through a microphone (e.g., a microphone 288) to identify data that correspond to the detected ultrasonic waves.

The display 260 (e.g., the display 160) may include a panel 262, a hologram device 264, a projector 266, and/or a control circuit for controlling them. The panel 262 may be implemented to be, for example, flexible, transparent, or wearable. The panel 262, together with the touch panel 252, may be configured as one or more modules. The hologram device 264 may show a three-dimensional image in the air using an interference of light. The projector 266 may display an image by projecting light onto a screen. The screen may be located, for example, inside or outside the electronic device 201. The interface 270 may include, for example, an HDMI 272, a USB 274, an optical interface 276, or a D-subminiature (D-sub) 278. The interface 270 may be included, for example, in the communication interface 170 illustrated in FIG. 1. Additionally or alternatively, the interface 270 may include, for example, a mobile high-definition link (MHL) interface, an SD card/multi-media card (MMC) interface, or an infrared data association (IrDA) standard interface.

The audio module 280, for example, may convert a sound into an electrical signal, and vice versa. At least some elements of the audio module 280 may be included, for example, in the input/output interface 145 illustrated in FIG. 1. The audio module 280 may process sound information that is input or output through, for example, a speaker 282, a receiver 284, earphones 286, the microphone 288, etc. The camera module 291 is a device that can photograph a still image and a moving image. According to an embodiment, the camera module 291 may include one or more image sensors (e.g., a front sensor or a rear sensor), a lens, an image signal processor (ISP), or a flash (e.g., an LED or xenon lamp). The power management module 295 may manage, for example, the power of the electronic device 201. According to an embodiment, the power management module 295 may include a power management integrated circuit (PMIC), a charger IC, or a battery or fuel gauge. The PMIC may have a wired and/or wireless charging scheme. Examples of the wireless charging scheme may include a magnetic resonance method, a magnetic induction method, an electromagnetic wave method, etc. Additional circuits (e.g., a coil loop, a resonance circuit, a rectifier, etc.) for wireless charging may be further included. The battery gauge may measure, for example, the residual quantity of the battery 296 and a voltage, current, or temperature while charging. The battery 296 may include, for example, a rechargeable battery and/or a solar battery.

The indicator 297 may display a particular state (e.g., a booting state, a message state, a charging state, etc.) of the electronic device 201 or a part thereof (e.g., the processor 210). The motor 298 may convert an electrical signal into a mechanical vibration and may generate a vibration, a haptic effect, etc. The electronic device 201 may include a mobile TV support device that can process media data according to a standard, such as digital multimedia broadcasting (DMB), digital video broadcasting (DVB), MediaFlo™, etc. Each of the above-described component elements of hardware according to the present disclosure may be configured with one or more components, and the names of the corresponding component elements may vary based on the type of electronic device. In various embodiments, an electronic device (e.g., the electronic device 201) may omit some elements or may further include additional elements, or some of the elements of the electronic device may be combined with each other to configure one entity, in which case the electronic device may identically perform the functions of the corresponding elements prior to the combination.

Figure 3:
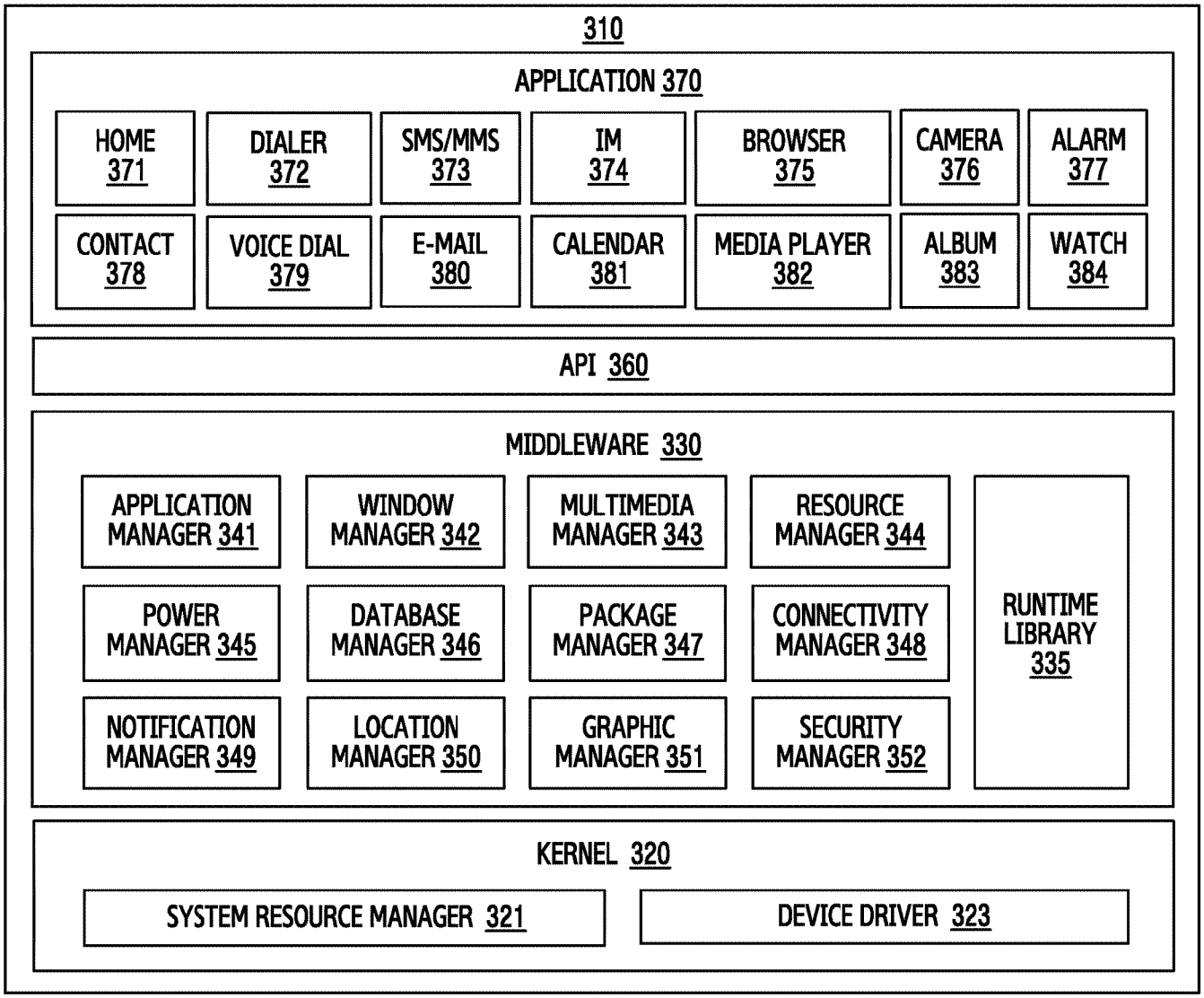
FIG. 3 is a block diagram of a program module according to various embodiments.

FIG. 3 is a block diagram of a program module according to various embodiments of the present disclosure.

According to an embodiment, the program module 310 (e.g., the program 140) may include an Operating System (OS) that controls resources relating to an electronic device (e.g., the electronic device 101) and/or various applications (e.g., the application programs 147) that are driven on the operating system. The operating system may include, for example, Android™, iOS™, Windows™, Symbian™, Tizen™, or Bada™. Referring to FIG. 3, the program module 310 may include a kernel 320 (e.g., the kernel 141), middleware 330 (e.g., the middleware 143), an API 360 (e.g., the API 145), and/or applications 370 (e.g., the application programs 147). At least a part of the program module 310 may be preloaded on the electronic device, or may be downloaded from an external electronic device (e.g., the electronic device 102 or 104 or the server 106).

The kernel 320 may include, for example, a system resource manager 321 and/or a device driver 323. The system resource manager 321 may control, allocate, or retrieve system resources. According to an embodiment, the system resource manager 321 may include a process manager, a memory manager, or a file system manager. The device driver 323 may include, for example, a display driver, a camera driver, a Bluetooth driver, a shared memory driver, a USB driver, a keypad driver, a WiFi driver, an audio driver, or an inter-process communication (IPC) driver.

For example, the middleware 330 may provide a function required by the applications 370 in common, or may provide various functions to the applications 370 through the API 360 to enable the applications 370 to use the limited system resources within the electronic device. According to an embodiment, the middleware 330 may include at least one of a runtime library 335, an application manager 341, a window manager 342, a multi-media manager 343, a resource manager 344, a power manager 345, a database manager 346, a package manager 347, a connectivity manager 348, a notification manager 349, a location manager 350, a graphic manager 351, and a security manager 352.

The runtime library 335 may include, for example, a library module used by a compiler in order to add a new function through a programming language while the applications 370 are being executed. The runtime library 335 may manage an input/output, manage a memory, or process an arithmetic function. The application manager 341 may manage, for example, the life cycles of the applications 370. The window manager 342 may manage GUI resources used for a screen. The multimedia manager 343 may identify formats required for reproducing various media files and may encode or decode a media file using a codec suitable for the corresponding format.

The resource manager 344 may manage the source codes of the applications 370 or the space of a memory. The power manager 345 may manage, for example, the capacity or power of a battery and may provide power information required for operating the electronic device. According to an embodiment, the power manager 345 may operate in conjunction with a basic input/output system (BIOS). The database manager 346 may, for example, generate, search, or change databases to be used by the applications 370. The package manager 347 may manage the installation or update of an application that is distributed in the form of a package file.

The connectivity manager 348 may manage, for example, wireless connection. The notification manager 349 may provide an event (e.g., an arrival message, an appointment, a proximity notification, etc.) to a user. The location manager 350 may manage, for example, the location information of the electronic device. The graphic manager 351 may manage, for example, a graphic effect to be provided to a user, or a user interface relating thereto. The security manage 352 may provide, for example, system security or user authentication. According to an embodiment, the middleware 330 may include a telephony manager for managing a voice or video call function of the electronic device or a middleware module that is capable of forming a combination of the functions of the above-described elements.

According to an embodiment, the middleware 330 may provide specialized modules according to the types of operation systems. The middleware 330 may dynamically remove some of the existing elements, or may add new elements. The API 360 is, for example, a set of API programming functions, and may be provided with different configurations according to operating systems. For example, in the case of Android or iOS, each platform may be provided with one API set, and in the case of Tizen, each platform may be provided with two or more API sets.

The applications 370 may include, for example, one or more applications that can perform functions, such as home 371, dialer 372, SMS/MMS 373, instant message (IM) 374, browser 375, camera 376, alarm 377, contacts 378, voice dial 379, e-mail 380, calendar 381, media player 382, album 383, watch 384, health care (e.g., measuring exercise quantity or blood glucose), providing of environment information (e.g., atmospheric pressure, humidity, or temperature information), and the like. According to an embodiment, the applications 370 may include an information exchange application that can support the exchange of information between the electronic device and an external electronic device. The information exchange application may include, for example, a notification relay application for relaying particular information to an external electronic device or a device management application for managing an external electronic device.

For example, the notification relay application may relay notification information generated in the other applications of the electronic device to an external electronic device, or may receive notification information from an external electronic device to provide the received notification information to a user. The device management application may install, delete, or update functions of an external electronic device that communicates with the electronic device (e.g., turning on/off the external electronic device itself (or some elements thereof) or adjusting the brightness (or resolution) of a display) or applications executed in the external electronic device. According to an embodiment, the applications 370 may include applications (e.g., a health care application of a mobile medical appliance) that are designated according to the attributes of an external electronic device. According to an embodiment, the applications 370 may include applications received from an external electronic device. At least some of the program module 310 may be implemented in software, firmware, hardware (e.g., the processor 210), or a combination of two or more thereof. At least some of the program module 310 may include, for example, a module, a program, a routine, a set of instructions, and/or a process for performing one or more functions.

Hereinafter, a gate driver may refer to a gate control circuit, an emission driver may refer to an emission control circuit, and a source driver may refer to a source control circuit.

Figure 4A:
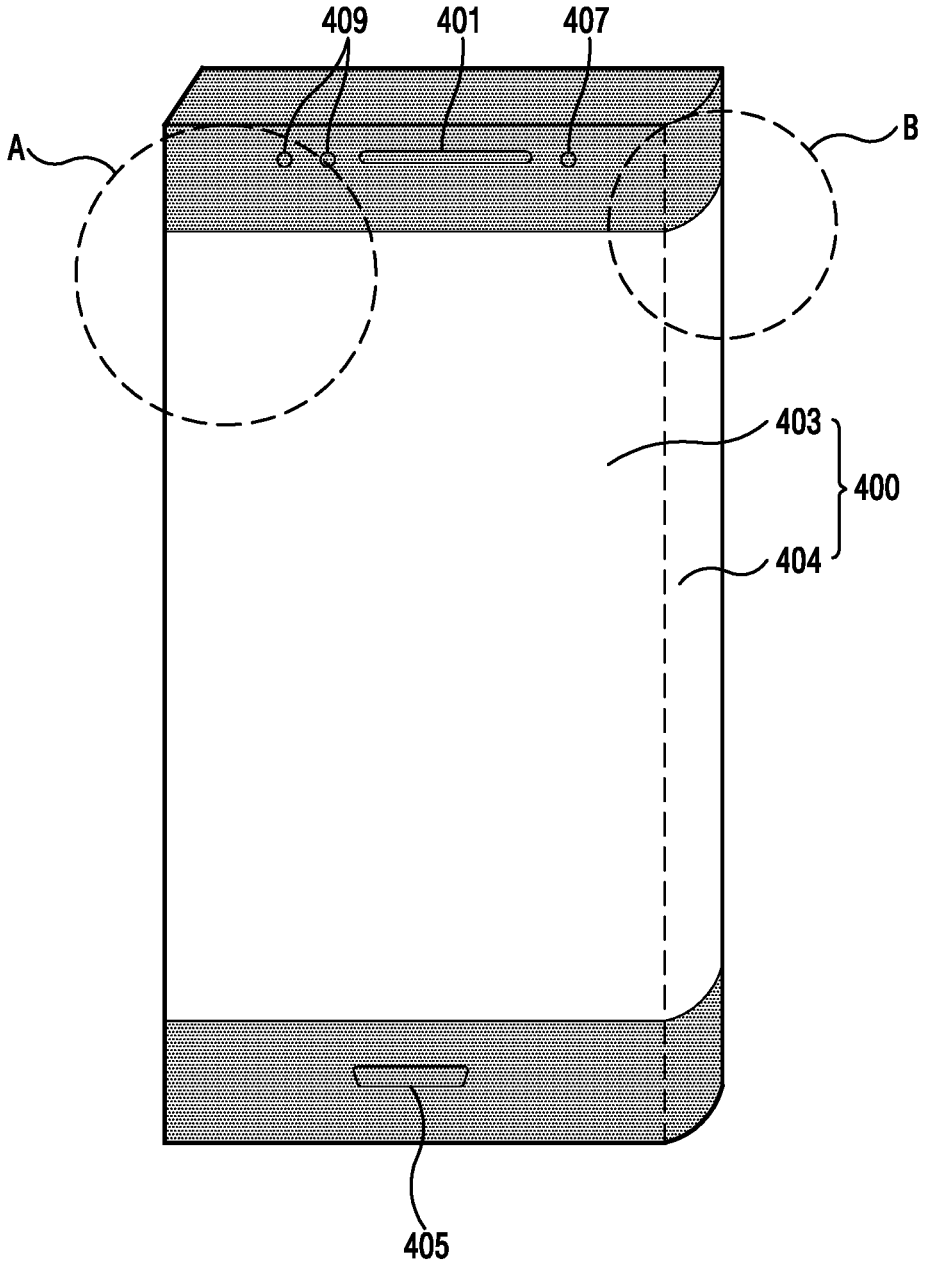
FIG. 4A to FIG. 4C are diagrams illustrating an example of implementing a driver related to display of an electronic device according to various embodiments.
Figure 4B:
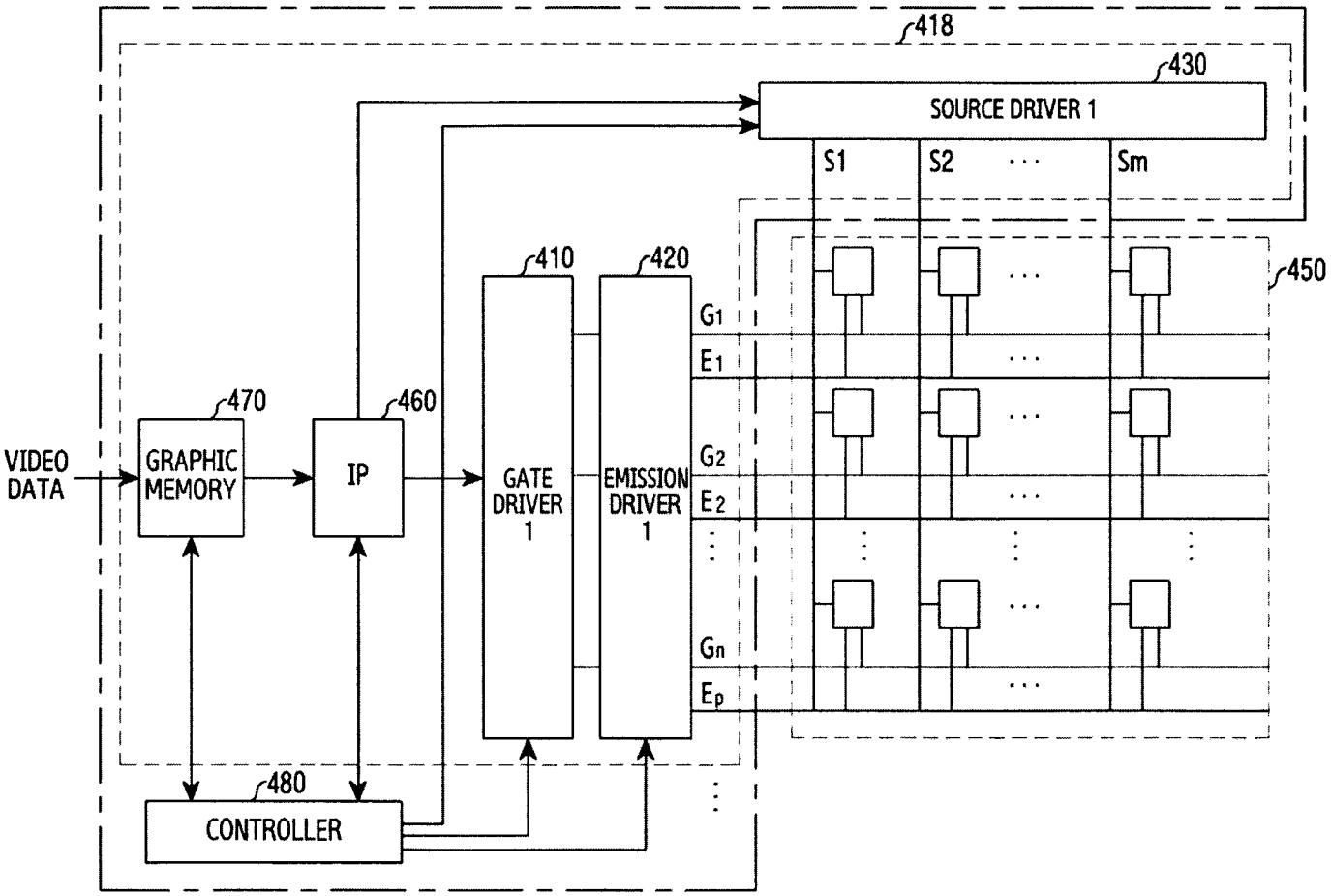
Figure 4C:
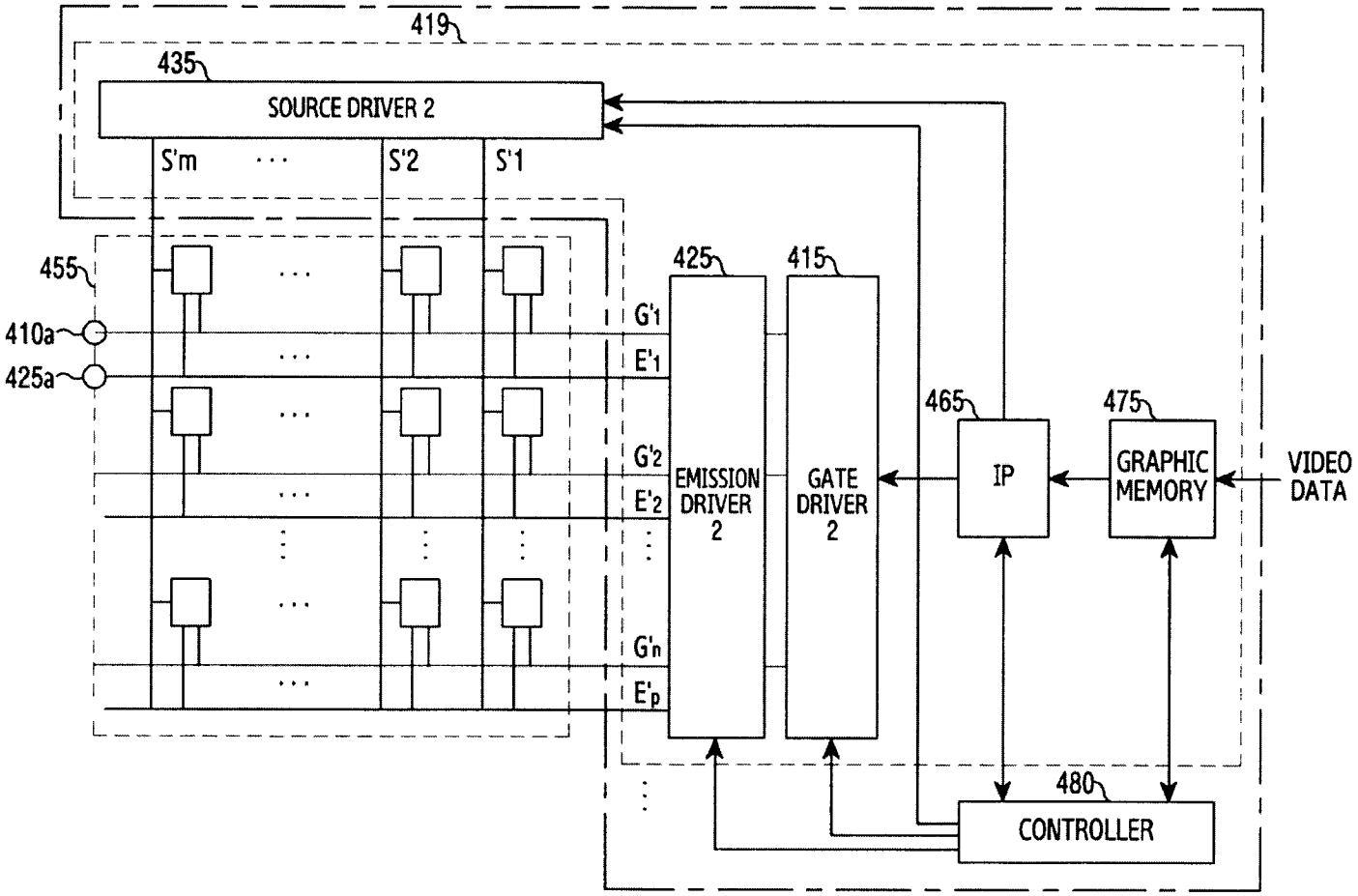

FIG. 4A to FIG. 4C are diagrams illustrating an example of implementing a driver related to display of an electronic device according to various embodiments. FIG. 4A illustrates an example of an electronic device having a display area thereof divided into two or more display areas. Referring to FIG. 4A, an electronic device (e.g., the electronic device 101 and the electronic device 201) is configured to include a display 400 (e.g., the display 160 and the display 260), a housing (or a main body) that is seated and coupled to the display 400, an additional device that is disposed in the housing to perform a function of the electronic device, and the like. In the following, the electronic device is described as the electronic device 101 in FIG. 1, but the description does not limit the electronic device.

For example, the additional device may include a speaker 401, a microphone 405, a camera module, an illuminance sensor 407, a communication interface (e.g., a charging or data input/output port, an audio input/output port, etc.), a button, and the like. According to various embodiments, the display 400 may be a bent display (bended display), a flexible display, or a flat display. For reference, a bended display or a flexible display may be twisted, bent, or rolled without damage due to a thin and flexible substrate like paper. According to various embodiments of the present disclosure, the display 400 may be coupled to the housing to maintain a bent shape.

The entire display area of the display 400 may be divided into at least two areas, for example, a first display area 403 and a second display area 404. The first display area 403 may be implemented on the front surface of the electronic device 101, and the second display area 404 may be disposed on at least one side surface (e.g., at least one surface among a right side surface, a left side surface, an upper side surface, and a lower side surface) of the electronic device 101. The second display area 404 may be disposed to extend laterally from the first display area 403. FIG. 4A illustrates an example in which the second display area 404 is extended to the right side surface of the electronic device 101.

The second display area 404 may be folded to a radius of curvature smaller than a radius of curvature (e.g., a radius of curvature of 5 cm, 1 cm, 7.5 mm, 5 mm, 4 mm, or the like) in which the display 400 is operable, and may be coupled to the side surface of the housing. However, the second display area 404 may be implemented in a flat shape having no radius of curvature. For example, when implemented in a flat shape, the second display area 404 may be obliquely formed to have a predetermined inclination angle from the first display area 403, or may be implemented in a rectangular shape.

According to various embodiments, the first display area 403 may be referred to as a main display area, and the second display area 404 may be referred to as a sub-display area. The sub-display area may be configured to be one or more. That is, FIG. 4A illustrates that the second display area 404 extends to the right side surface of the electronic device 101, but the second display area 404 may be disposed to extend to the left side surface of the electronic device 101 have. When there are two or more sub-display areas, a sub-display area disposed on the left side surface with respect to the main display area may be specified as a second display area, and a sub-display area disposed on the right side surface with respect to the main display area may be specified as a third display area.

Hereinafter, the first display area 403 and the second display area 404 are divided for convenience of description, and do not mean that they physically separated. According to various embodiments, the first display area 403 and the second display area 404 have at least one end that is bent, and may be implemented by the single display 400 having at least one bent end extending to the side surface of the electronic device. According to various embodiments, the at least one bent end may extend to the rear surface of the electronic device 101 depending on an implementation method.

According to various embodiments, the display 400 may support input and output, and may simultaneously or independently process input and output through the first display area 403 and the second display area 404. For example, the electronic device 101 may include drivers that drive the first display area 403 and the second display area 404, respectively. In this case, the two drivers may be connected or disconnected in terms of hardware. According to various embodiments, when only the first display area 403 is used, the processor 120 may perform a control to drive a driver that controls the first display area 403 and to disable or inactive a driver that controls the second display area 404. Alternatively, when only the second display area 404 is used, the processor 120 may perform a control to drive the driver that controls the second display area 404, and to disable or inactive the driver that controls the first display area 403. Alternatively, when both the first display area 403 and the second display area 404 are used, the processor 120 may drive both the driver that controls the first display area 403 and the driver that controls the second display area 404.

FIG. 4B illustrates an example of a display device for driving the first display area 403 in FIG. 4A. For reference, FIG. 4B is an enlarged view of area A in the display 400 in FIG. 4A.

Referring to FIG. 4B, a display device 440 may include a display panel 450 and a display driver circuit 418 for controlling the display panel. The display driver circuit 1 418 may be an integrated circuit referred to as a Display Drive Integrated Circuit (IC) (DDI). According to an embodiment, the display device 440 may further include a controller 480.

The display panel 450 may include a pixel array (or a pixel group) including a plurality of pixels. The display panel 450 may include the first display area 403 corresponding to a first pixel group and the second display area 404 corresponding to a second pixel group. The pixel array is to convert an electrical signal to an optical signal, and provides a display area to be used as a screen on which an image is displayed. Each pixel of the pixel array may be independently driven by the display device 440. The display panel 450 may include, for example, a configuration identical or similar to that of the display 160 and the panel 262.

The display driver circuit 1 418 may be driven according to video data input to the display panel 450. This display driver circuit 1 418 may be used for processing video data input to the first display area 403. The video data may be input from the electronic device using the display panel 450. The display device 440 may be included in the electronic device using the display panel 450.

The display driver circuit 1 418 may include a graphic memory 1 470, an image processor (IP) 1 460, a gate driver 1 410, an emission driver 1 420, and a source driver 1 430. The graphic memory 1 470 buffers video data input from the electronic device 101. The IP 1 460 processes the video data buffered by the graphic memory 1 470. For example, the IP 1 460 may perform various image processing, such as quality improvement, resolution conversion, or compression of the video data.

There may be a case where processing for improving screen display quality by the display device 440 is not required. In this case, the IP 1 460 may not be included in the display driver circuit 1 418 and may be omitted.

The gate driver 1 410 (or a gate control circuit 1 410) may scan gate lines G1-Gn connected to pixels of the display panel 450 to drive the same. That is, the gate driver 1 410 is connected to the first display area 403, and may be used to control at least some pixels of the first pixel group of the first display area 403. The gate driver 1 410 may sequentially select the gate lines G1-Gn one by one to generate a gate control signal. This gate driver 1 410 is also referred to as "a scan driver".

The emission driver 1 420 (or an emission control circuit 1 420) may drive emission lines E1-Ep connected to pixels of the display panel 450. That is, the emission driver 1 420 is connected to the first display area 403, and may be used to supply power to at least some pixels of the first pixel group of the first display area 403. The emission driver 1 420 may sequentially select the emission lines E1-Ep one by one to generate an emission control signal for supplying power to the first pixel group.

The source driver 1 430 (or a source control circuit 1 430) may drive source lines S1-Sm connected to pixels of the display panel 450 to correspond to the video data processed by the IP 1 460. That is, the source driver 1 430 is connected to the first display area 403, and may be used to provide data to at least some pixels of the first pixel group. A driver like the source driver 1 430 is also generally referred to as "a data driver". The gate driver 1 410, the emission driver 1 420, and the source driver 1 430 may be used to drive a part of the display, for example, the first display area 403 in FIG. 4A. The gate driver 1 410, the emission driver 1 420, and the source driver 1 430 may drive the first display area 403 under control of the processor 120 or the controller 480.

FIG. 4C illustrates an example of the display device for driving the second display area 404 in FIG. 4A. For reference, FIG. 4C is an enlarged view of area B in the display 400 in FIG. 4A.

Referring to FIG. 4C, the display device 440 may include a display panel 455 and a display driver circuit 2 419 for controlling the display panel. For reference, the display panel 450 in FIG. 4B is for the first display area 403, and the display panel 455 in FIG. 4C is for the second display area 404. The display panel 450 in FIG. 4B and the display panel 455 in FIG. 4C are divided for convenience of description, and do not mean that they physically separated.

The display driver circuit 2 419 is driven according to video data input to the display panel 455. The display driver circuit 2 419 may be used for processing video data input to the second display area 404. The video data may be input from the electronic device using the display panel 455.

The display driver circuit 2 419 may include a graphic memory 2 475, an IP 2 465, a gate driver 2 415, an emission driver 2 425, and a source driver 2 435. The graphic memory 2 475 buffers video data input from the electronic device 101. The IP 2 465 processes the video data buffered by the graphic memory 2 475 to improve a screen display quality.

The gate driver 2 415 (or a gate control circuit 2 415) may scan gate lines G'1-G'n connected to pixels of the display panel 450 to drive the same. That is, the gate driver 2 415 is connected to the second display area 404, and may be used to control at least some pixels of the second pixel group of the second display area 404. The gate driver 2 415 may sequentially select the gate lines G'1-G'n one by one to generate a gate control signal.

The emission driver 2 425 (or an emission control circuit 2 425) may scan emission lines E'1-E'p connected to pixels of the display panel 450 to drive the same. That is, the emission driver 2 425 is connected to the second display area 404, and may be used to supply power to at least some pixels of the second pixel group of the second display area 404. The emission driver 2 425 may sequentially select the emission lines E'1-E'p one by one to generate an emission control signal for supplying power to the second pixel group.

The source driver 2 435 (or a source control circuit 2 435) drives source lines S'1-S'm connected to pixels of the display panel 450 to correspond to the video data processed by the IP 2 465. That is, the source driver 2 435 is connected to the second display area 404, and may be used to provide data to at least some pixels of the second pixel group of the second display area 404. The gate driver 2 415, the emission driver 2 425, and the source driver 2 435 may be used to drive the second display area 404 in FIG. 4A. The gate driver 2 415, the emission driver 2 425, and the source driver 2 435 may drive the second display area 410 under control of the processor 120 or the controller 480.

According to various embodiments, a gate line forming area 410*a* and an emission line forming area 425*a* are enlarged views of driver lines disposed between the display panel 450 and the display panel 455. Referring to the gate line forming area 410*a*, gate line "Gn" of the gate driver 1 410 is connected with gate line "G'n" of the gate driver 2 415. On the other hand, it can be seen that emission line "Ep" of the emission driver 1 420 is not connected with emission line "E'p" of the emission driver 2 425.

Therefore, the display device 440 may simultaneously or independently drive the first display area 403 and the second display area 404. For example, when both the first display area 403 and the second display area 404 are used, the controller 480 may drive the gate driver 1 410, the emission driver 1 420, and the source driver 1 430 to drive the first display area 403, and may drive the gate driver 2 415, the emission driver 2 425, and the source driver 2 435 to drive the second display area 404.

Alternatively, when only the first display area 403 is used, the controller 480 may not drive the gate driver 2 415, the emission driver 2 425, and the source driver 2 435, and may only drive the gate driver 1 410, the emission driver 1 420, and the source driver 1 430 to drive the first display area 403. Alternatively, when only the second display area 404 is used, the controller 480 may not drive the gate driver 1 410, the emission driver 1 420, and the source driver 1 430, and may drive only the gate driver 2 415, the emission driver 2 425, and the source driver 2 435 to drive the second display area 404.

In FIG. 4B and FIG. 4C illustrates that the display device 440 includes each of the display driver circuit 1 418 for controlling the first display area 403 and the display driver circuit 2 419 for controlling the second display area 404. However, the display device 440 may control both the first display area 403 and the second display area 404 by using a single display driver circuit. Further, it is illustrated that the display device 440 includes the single controller 480 for controlling the first display area 403 and the second display area 404. However, the display device 440 may control the first display area 403 and the second display area 404 by using a single controller, or may control the first display area 403 and the second display area 404 by using two controllers, respectively. Therefore, the display device 440 is not limited by the drawings. In addition to the controller 480, it is also illustrated that each of one IP and one graphic memory is provided to control the first display area 403 and the second display area 404. However, one IP or one graphic memory may be used to control both the first display area 403 and the second display area 404.

Hereinafter, various hardware embodiments of display-related drivers for individually controlling the first display area 403 and the second display area 404 will be described.

FIG. 5 to FIG. 11 are diagrams illustrating various examples of implementing a driver related to display of an electronic device according to various embodiments.

Figure 5:
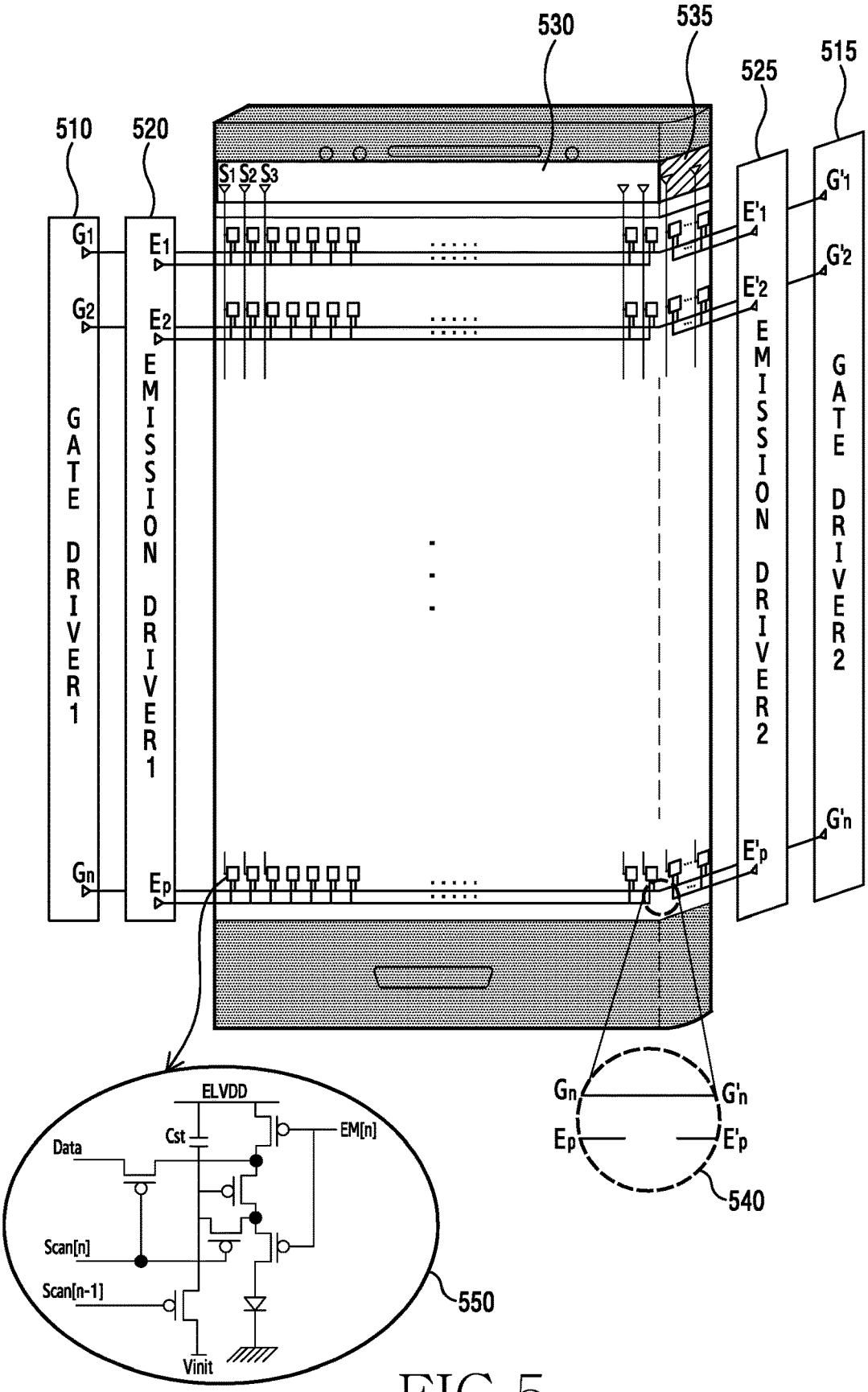
FIG. 5 to FIG. 11 are diagrams illustrating various examples of implementing a driver related to display of an electronic device according to various embodiments.

FIG. 5 illustrates an example in which emission drivers are separated. FIG. 5 may show an example of driver implementation in which the electronic device 101 uses an OLED as a display element. Further, FIG. 5 shows the electronic device 101 including a first display area (e.g., the first display area 403) on the front surface of the electronic device 101 and a second display area (e.g., the second display area 404) on the right side surface from the first display area, as in FIG. 4A.

FIG. 5 illustrates an example in which the electronic device 101 has two gate drivers, two emission drivers, and two source drivers for controlling the first display area and the second display area, respectively. According to various embodiments, the electronic device 101 may have two emission drivers for driving the first display area and the second display area, respectively, and may have only one gate driver or one source driver.

A gate driver 1 510 and an emission driver 1 520 are for controlling the first display area 403, and may be disposed on the left side of the electronic device 101. Further, a source driver 1 530 for providing data to the first display area 403 may be disposed on the upper side of the electronic device 101. The gate driver 1 510 may control the gate lines G1-Gn connected to pixels of the display panel 450 to control at least some pixels of the first pixel group of the first display area 403. The emission driver 1 520 may control the emission lines E1-Ep connected to pixels of the display panel 450 to supply power to at least some pixels of the first pixel group of the first display area 403. The source driver 1 530 may control the source lines S1-Sm connected to pixels of the display panel 450 to provide data to at least some pixels of the first pixel group of the first display area 403.

The gate driver 2 515 and the emission driver 2 525 are for controlling the second display area 404, and may be disposed on the right side of the electronic device 101. Further, the source driver 2 535 for providing data to the second display area 404 may be disposed on the upper side of the electronic device 101, for example, next to the source driver 1 530. The gate driver 2 515 may control the gate lines G'1-G'n connected to pixels of the display panel 450 to control at least some pixels of the second pixel group of the second display area 404. The emission driver 2 525 may control the emission lines E'1-E'p connected to pixels of the display panel 450 to supply power to at least some pixels of the second pixel group of the second display area 404. The source driver 2 535 may control the source lines S'1-S'm connected to pixels of the display panel 450 to provide data to at least some pixels of the second pixel group of the second display area 404.

The gate driver 1 510 and the gate driver 2 515 disposed on both sides may be connected to each other in terms of hardware (or physically). That is, the gate lines G1-Gn of the gate driver 1 510 may be formed to be connected with the gate lines G'1-G'n of the gate driver 2 515 in terms of hardware (or physically). However, the emission driver 1 520 and the emission driver 2 525 disposed on both sides may not be connected in terms of hardware (or physically). That is, the emission lines E1-Ep of the emission driver 1 520 and the emission lines E'1-E'p the emission driver 2 525 may not be connected in terms of hardware (or physically), and may be separated from each other.

A line forming area 540 illustrated in FIG. 5 is an enlarged view of driver lines disposed between the first display area and the second display area. Referring to the line forming area 540, it can be seen that gate line "Gn" of the gate driver 1 510 is connected with gate line "G'n" of the gate driver 2 515, while emission line "Ep" of the emission driver 1 520 is not connected with emission line "E'p" of the emission driver 2 525.

According to various embodiments, when only one of the first display area and the second display area of the electronic device 101 is to be driven, the electronic device 101 may drive only a driver of the display area to be driven. For example, when only the second display area is to be driven, only the gate driver 2 515, the emission driver 2 525, and the source driver 2 535 may be driven, and the gate driver 1 510, the emission driver 1 520, and the source driver 1 530 may not be driven. Therefore, when only the drivers corresponding to the second display area are driven, power can be saved compared with a case where all the drivers corresponding to the first display area and the second display area are driven. On the other hand, when only the first display area is used, the gate driver 1 510, the emission driver 1 520, and the source driver 1 530 may be driven, and the gate driver 2 515, the emission driver 2 525, and the source driver 2 535 may not be driven.

For reference, reference numeral 550 illustrates a circuit diagram of a chip used as a display element. The types of chips are various, and one type of chip is illustrated in the drawing. The types of chips are not limited by the drawing. Although FIG. 5 illustrates that the gate driver and the emission driver are disposed on the right and left side surfaces of the electronic device and the source driver is disposed on the upper side surface of the electronic device, the gate driver and the emission driver may be disposed on the upper or lower side of the electronic device, or the source driver may be disposed on the right or left side of the electronic device.

Figure 6:
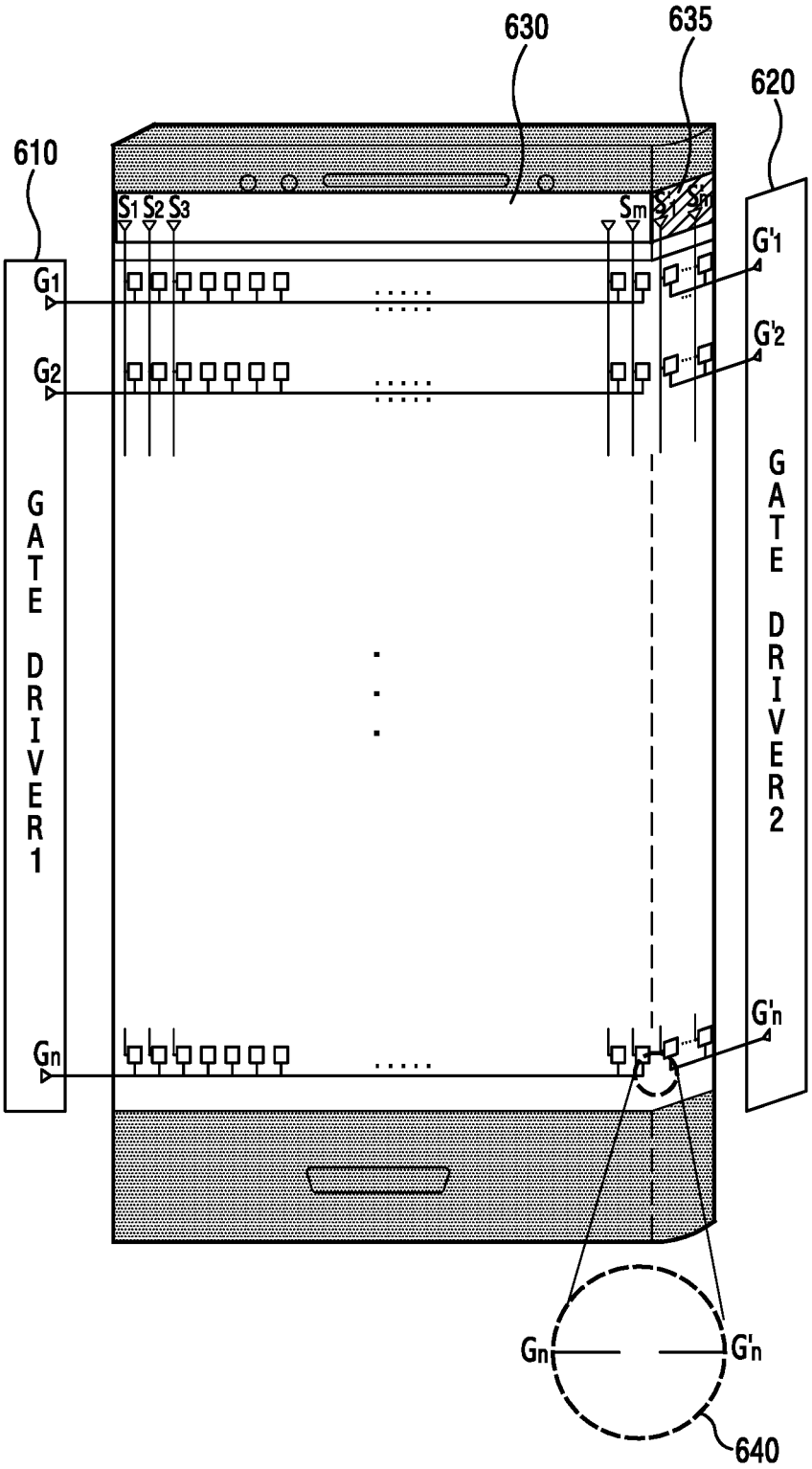

FIG. 6 illustrates an example in which gate drivers are separated according to various embodiments. FIG. 6 may show an example of driver implementation in which the electronic device 101 uses a Thin Film Transistor (TFT) as a display element. When a thin film transistor is used, the electronic device 101 may not include an emission driver and may include only a source driver and a gate driver. When no emission driver is included, a gate driver may function as an emission driver. Further, FIG. 6 shows the electronic device 101 including a first display area (e.g., the first display area 403) on the front surface of the electronic device 101 and a second display area (e.g., the second display area 404) on the right side surface from the first display area, as in FIG. 4A.

Referring to FIG. 6, the electronic device 101 may have two gate drivers and two source drivers for controlling the first display area and the second display area, respectively. A gate driver 1 610 is for controlling the first display area 403, and may be disposed on the left side of the electronic device 101. Further, a source driver 1 630 for controlling the first display area 403 may be disposed on the upper side of the electronic device 101. The gate driver 1 610 may control the gate lines G1-Gn connected to pixels of the display panel 450 to control at least some pixels of the first pixel group of the first display area 403. That is, the gate driver 1 610 may supply power to at least some pixels of the first group in the first display area 403. The source driver 1 630 may control the source lines S1-Sm connected to pixels of the display panel 450 to provide data to at least some pixels of the first pixel group of the first display area 403.

A gate driver 2 620 is for controlling the second display area 404, and may be disposed on the right side of the electronic device 101. Further, the source driver 2 635 for controlling the second display area 404 may be disposed on the upper side of the electronic device 101, for example, next to the source driver 1 630. The gate driver 2 620 may control the gate lines G'1-G'n connected to pixels of the display panel 450 to control at least some pixels of the second pixel group of the second display area 404. That is, the gate driver 2 620 may supply power to at least some pixels of the second pixel group of the second display area 404. The source driver 2 635 may control the source lines S'1-S'm connected to pixels of the display panel 450 to provide data to at least some pixels of the second pixel group of the second display area 404.

The gate driver 1 610 and the gate driver 2 620 disposed on both sides may not be connected to each other in terms of hardware (or physically). That is, the gate lines G1-Gn of the gate driver 1 610 may not be connected with the gate lines G'1-G'n of the gate driver 2 620 in terms of hardware (or physically), and may be separated from each other. That is, a line forming area 640 is an enlarged view of driver lines disposed between the first display area and the second display area. Referring to the line forming area 640, it can be seen that gate line "Gn" of the gate driver 1 610 is not connected with gate line "G'n" of the gate driver 2 620.

According to various embodiments, when only one of the first display area and the second display area is to be driven, only a driver of the display area to be driven may be driven. For example, when only the second display area is to be driven, only the gate driver 2 620 and the source driver 2 635 may be driven, and the gate driver 1 610 and the source driver 1 630 may not be driven. Therefore, when only the drivers corresponding to the second display area are to be driven, power can be saved compared with a case where all the drivers corresponding to the first display area and the second display area are driven. On the other hand, when only the first display area is used, the gate driver 1 610, the source driver 1 630 may be driven, and the gate driver 2 620 and the source driver 2 635 may not be driven.

Although FIG. 6 illustrates that the gate driver is disposed on the right and left side surfaces of the electronic device, and the source driver is disposed on the upper side surface of the electronic device, the gate driver may be disposed on the upper or lower side of the electronic device, or the source driver may be disposed on the right or left side of the electronic device.

Figure 7:
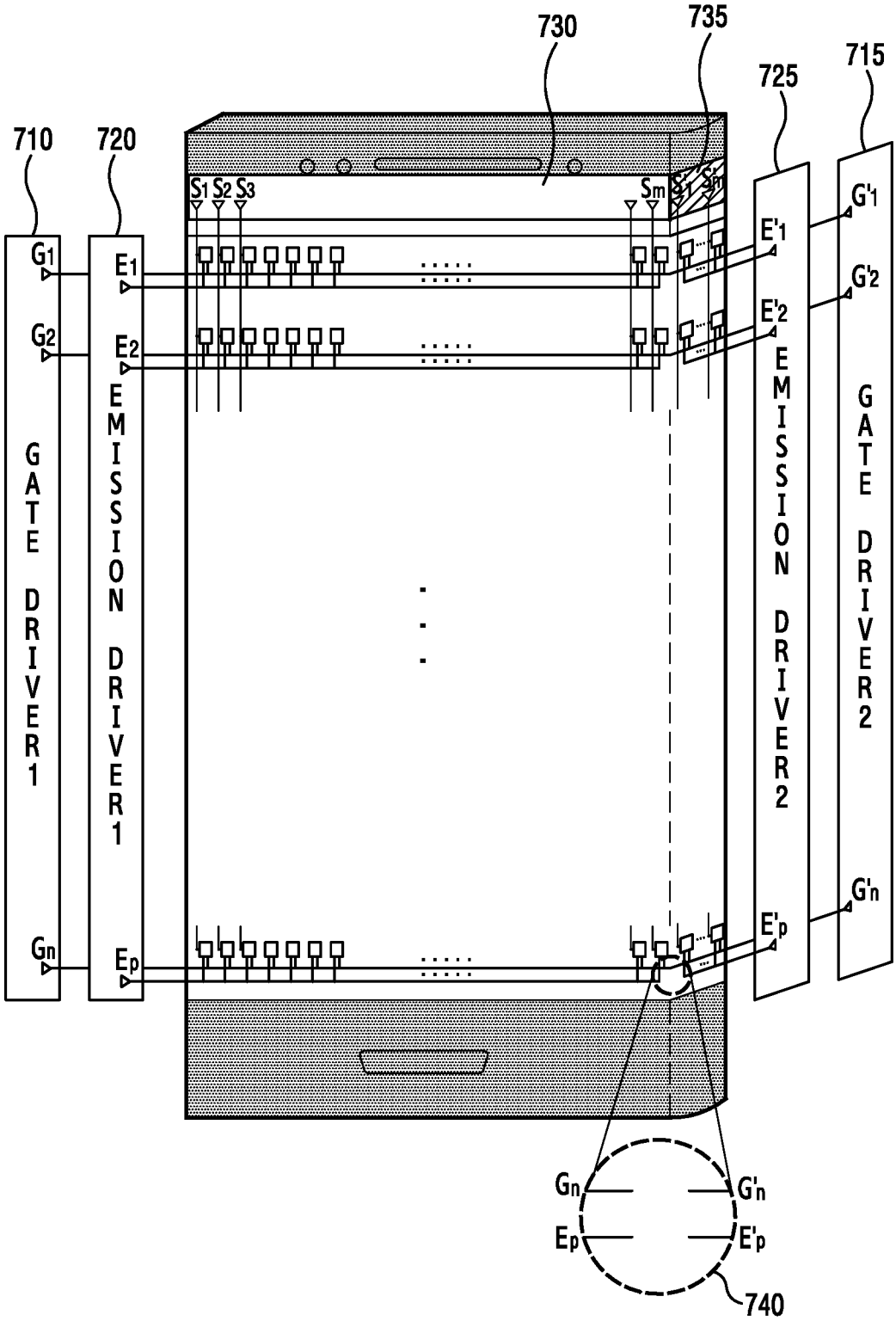

FIG. 7 illustrates an example in which gate drivers and emission drivers are separated according to various embodiments. FIG. 7 may show an example of driver implementation of a case where the electronic device 101 uses an OLED as a display element. The example of driver implementation in FIG. 7 is similar to the example of driver implementation previously described in FIG. 5, and therefore detailed descriptions thereof will be omitted.

Referring to FIG. 7, two gate drivers, two emission drivers, and two source drivers may be implemented to control the first display area and the second display area, respectively. A gate driver 1 710 and an emission driver 1 720 are for controlling the first display area, and may be disposed on the left side of the electronic device 101. Further, a source driver 1 730 for controlling the first display area may be disposed on the upper side of the electronic device 101. A gate driver 2 715 and an emission driver 2 725 are for controlling the second display area, and may be disposed on the right side of the electronic device 101. Further, a source driver 2 735 for controlling the first display area may be dispose on the upper side of the electronic device 101, for example, next to the source driver 1 730.

The gate driver 1 710 and the gate driver 2 715 disposed on both sides may not be connected to each other in terms of hardware (or physically). That is, the gate lines G1-Gn of the gate driver 1 710 may not to be connected with the gate lines G'1-G'n of the gate driver 2 715 in terms of hardware (or physically). Further, the emission driver 1 720 and the emission driver 2 725 disposed on both sides may not be connected to each other in terms of hardware (or physically). That is, the emission lines E1-Ep of the emission driver 1 720 and the emission lines E'1-E'p the emission driver 2 725 may not be connected in terms of hardware (or physically), and may be separated from each other.

A line forming area 740 illustrated in FIG. 7 is an enlarged view of driver lines disposed between the first display area and the second display area. Referring to the line forming area 740, it can be seen that gate line "Gn" of the gate driver 1 710 and gate line "G'n" of the gate driver 2 715 are not connected, and emission line "Ep" of the emission driver 1 720 and emission line "E'p" of the emission driver 2 725 are not connected.

Comparing the line forming area 540 illustrated in FIG. 5 with the line forming area 740 illustrated in FIG. 7, it can be seen that gate lines are connected and only emission lines are disconnected in FIG. 5, while gate lines are disconnected and emission lines are also disconnected in FIG. 7.

According to various embodiments, when only one of the first display area and the second display area is to be driven, only a driver of the display area to be driven may be driven. For example, when only the second display area is to be driven, only the gate driver 2 715, the emission driver 2 725, and the source driver 2 735 may be driven, and the gate driver 1 710, the emission driver 1 720, and the source driver 1 730 may not be driven. Therefore, when only the drivers corresponding to the second display area are driven, power can be saved compared with a case where all the drivers corresponding to the first display area and the second display area are driven. On the other hand, when only the first display area is used, the gate driver 1 710, the emission driver 1 720, and the source driver 1 730 may be driven, and the gate driver 2 715, the emission driver 2 725, and the source driver 2 735 may not be driven.

Figure 8:
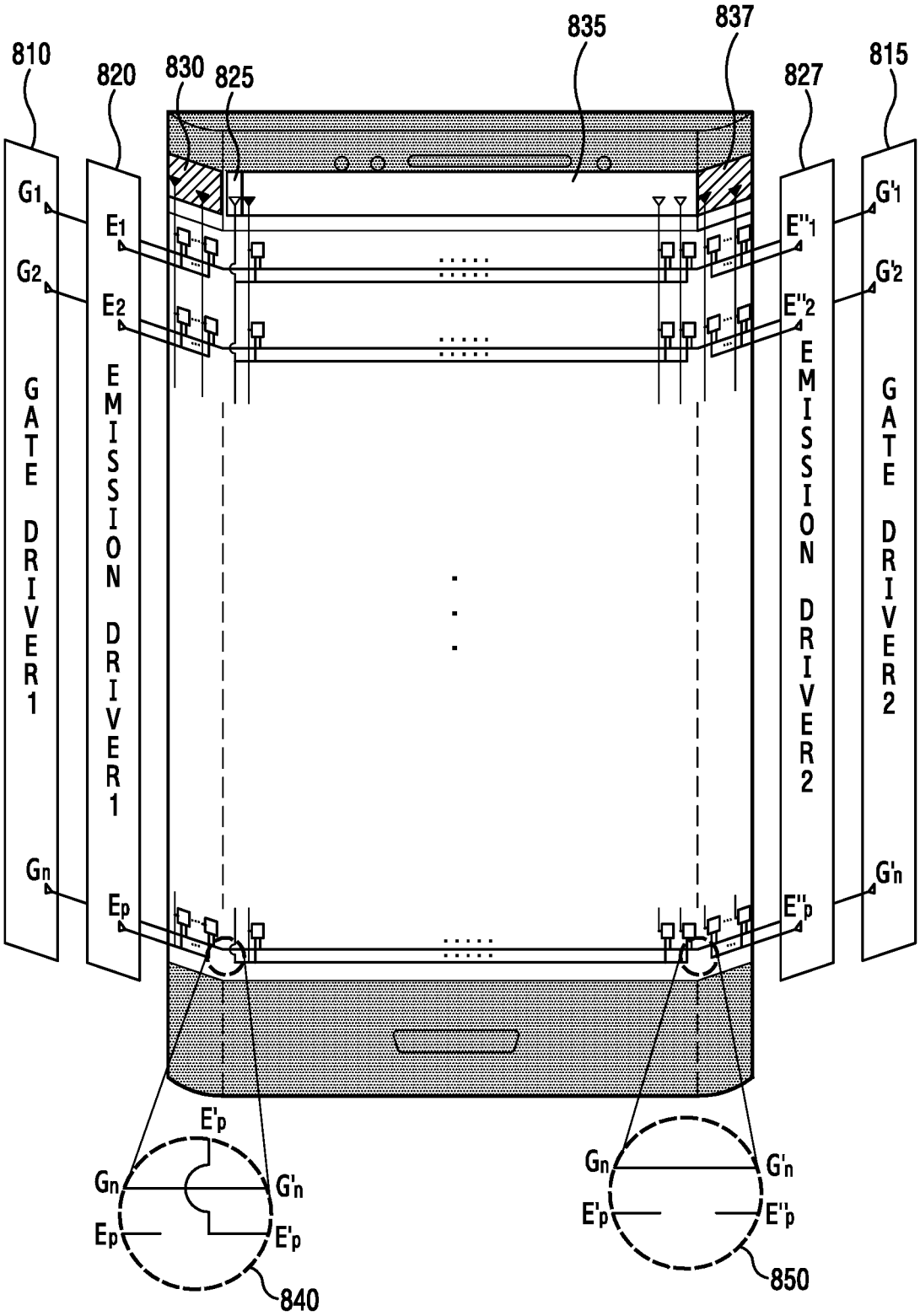

FIG. 8 illustrates an example in which emission drivers are separated. FIG. 8 may show an example of driver implementation of a case where the electronic device 101 uses an OLED as a display element. Further, FIG. 8 shows the electronic device 101 including a first display area (e.g., the first display area 403) on the front surface of the electronic device 101, a second display area on the left side surface from the first display area, and a third display area on the right side surface from the first display area. For example, the display panel of the electronic device 101 may include a first display area corresponding to a first pixel group, a second display area corresponding to a second pixel group, and a third display area corresponding to a third pixel group. Unlike previously described FIG. 5 to FIG. 7, FIG. 8 describes an example of driver implementation in the electronic device 101 includes three display areas.

Referring to FIG. 8, the electronic device 101 may include two gate drivers for controlling the first display area to the third display area, and three emission drivers and three source drivers for controlling the first display area to the third display area, respectively. According to various embodiments, the electronic device 101 may have three emission drivers for driving the first display area to the third display area, respectively, and may have only one gate driver and one source driver.

A gate driver 1 810 and an emission driver 1 820 are for controlling the second display area, and may be disposed on the left side of the electronic device 101. Further, a source driver 1 830 for controlling the second display area may be disposed on the upper side of the second display area of the electronic device 101. The gate driver 1 810 may control the gate lines G1-Gn connected to pixels of the display panel 450 to control at least some pixels of the second pixel group of the second display area. The emission driver 1 820 may control the emission lines E1-Ep connected to pixels of the display panel 450 to supply power to at least some pixels of the second pixel group of the second display area. The source driver 1 830 may control the source lines S1-Sm connected to pixels of the display panel 450 to provide data to at least some pixels of the second pixel group of the second display area.

The emission driver 2 825 is for controlling the first display area, and may be disposed on the upper side of the first display area of the electronic device 101. The emission driver 2 825 may control the emission lines E'1-E'p connected to pixels of the display panel 450 to supply power to at least some pixels of the first pixel group of the first display area. Further, the source driver 2 835 for controlling the first display area may be disposed on the upper side of the electronic device 101, for example, next to the emission driver 2 825. The source driver 2 835 may control the source lines S'1-S'm connected to pixels of the display panel 450 to provide data to at least some pixels of the first pixel group of the first display area.

According to various embodiments, the emission driver 1 820 and the emission driver 2 825 may not be connected to each other in terms of hardware (or physically). That is, the emission lines E1-Ep of the emission driver 1 820 and the emission lines E'1-E'p of the emission driver 2 825 may not be connected in terms of hardware (or physically), and may be separated from each other.

A line forming area 840 is an enlarged view of driver lines disposed between the first display area and the second display area. Referring to the line forming area 840, it can be seen that gate line "Gn" of the gate driver 1 810 is connected with gate line "G'n" of the gate driver 2 815, while emission line "Ep" of the emission driver 1 820 and emission line "E'p" of the emission driver 2 825 are not connected.

The gate driver 2 815 and an emission driver 3 827 are for controlling the third display area, and may be disposed on the right side of the electronic device 101. Further, a source driver 3 837 for controlling the third display area may be disposed on the upper side of the third display area. The gate driver 2 815 may control the gate lines G1-Gn connected to pixels of the display panel 450 to control at least some pixels of the third pixel group of the third display area. The emission driver 3 827 may control emission lines E"1-E"p connected to pixels of the display panel 450 to supply power to at least some pixels of the third pixel group of the third display area. The source driver 3 837 may control the source lines S"1-S"m connected to pixels of the display panel 450 to provide data to at least some pixels of the third pixel group of the third display area.

According to various embodiments, the emission driver 2 825 and the emission driver 3 827 may not be connected in terms of hardware (or physically). That is, the emission lines E'1-E'p of the emission driver 2 825 and the emission lines E"1-E"p of the emission driver 3 827 are not connected in terms of hardware (or physically), and may be separated from each other. A line forming area 850 is an enlarged view of driver lines disposed between the first display area and the third display area. Referring to the line forming area 850, it can be seen that gate line "Gn" of the gate driver 1 810 is connected with gate line "G'n" of the gate driver 2 815, while emission line "E'p" of the emission driver 2 825 and emission line "E"p" of the emission driver 3 827 are not connected.

According to various embodiments, when only one of the first display area to the third display area of the electronic device 101 is to be driven, the electronic device 101 may drive only a driver of the display area to be driven. For example, when only the first display area is used, only the gate driver 1 810, the emission driver 2 825, and the source driver 2 835 may be driven, and the emission driver 1 820, the emission driver 3 827, the source driver 1 830, and the source driver 3 837 may not be driven.

Alternatively, when only the second display area is to be driven, only the gate driver 1 810, the emission driver 1 820, and the source driver 1 830 may be driven, and the emission driver 2 825, the emission driver 3 827, the source driver 2 835, and the source driver 3 837 may not be driven. Therefore, when only the drivers corresponding to the second display area are driven, power can be saved compared with a case where all the drivers corresponding to the first display area to the third display area are driven.

Alternatively, when only the third display area is to be driven, only the gate driver 2 815, the emission driver 3 827, and the source driver 3 837 may be driven, and the emission driver 1 820, the emission driver 2 825, the source driver 1 830, and the source driver 3 837 may not be driven. Therefore, when only the drivers corresponding to the third display area are driven, power can be saved compared with a case where all the drivers corresponding to the first display area to the third display area are driven.

Alternatively, when the first display area and the second display area are to be driven, the gate driver 1 810, the gate driver 2 815, the emission driver 1 820, the emission driver 2 825, the source driver 1 830, and the source driver 2 835 may be driven, and the emission driver 3 827 and the source driver 3 837 may not be driven.

Alternatively, when the first display area and the third display area are to be driven, the gate driver 1 810, the gate driver 2 815, the emission driver 2 825, the emission driver 3 827, the source driver 2 835, and the source driver 3 837 may be driven, and the emission driver 1 820 and the source driver 1 830 may not be driven.

Alternatively, when the second display area and the third display area are to be driven, the gate driver 1 810, the gate driver 2 815, the emission driver 1 820, the emission driver 3 827, the source driver 1 830, and the source driver 3 837 may be driven, and the emission driver 2 825 and the source driver 2 835 may not be driven.

Figure 9:
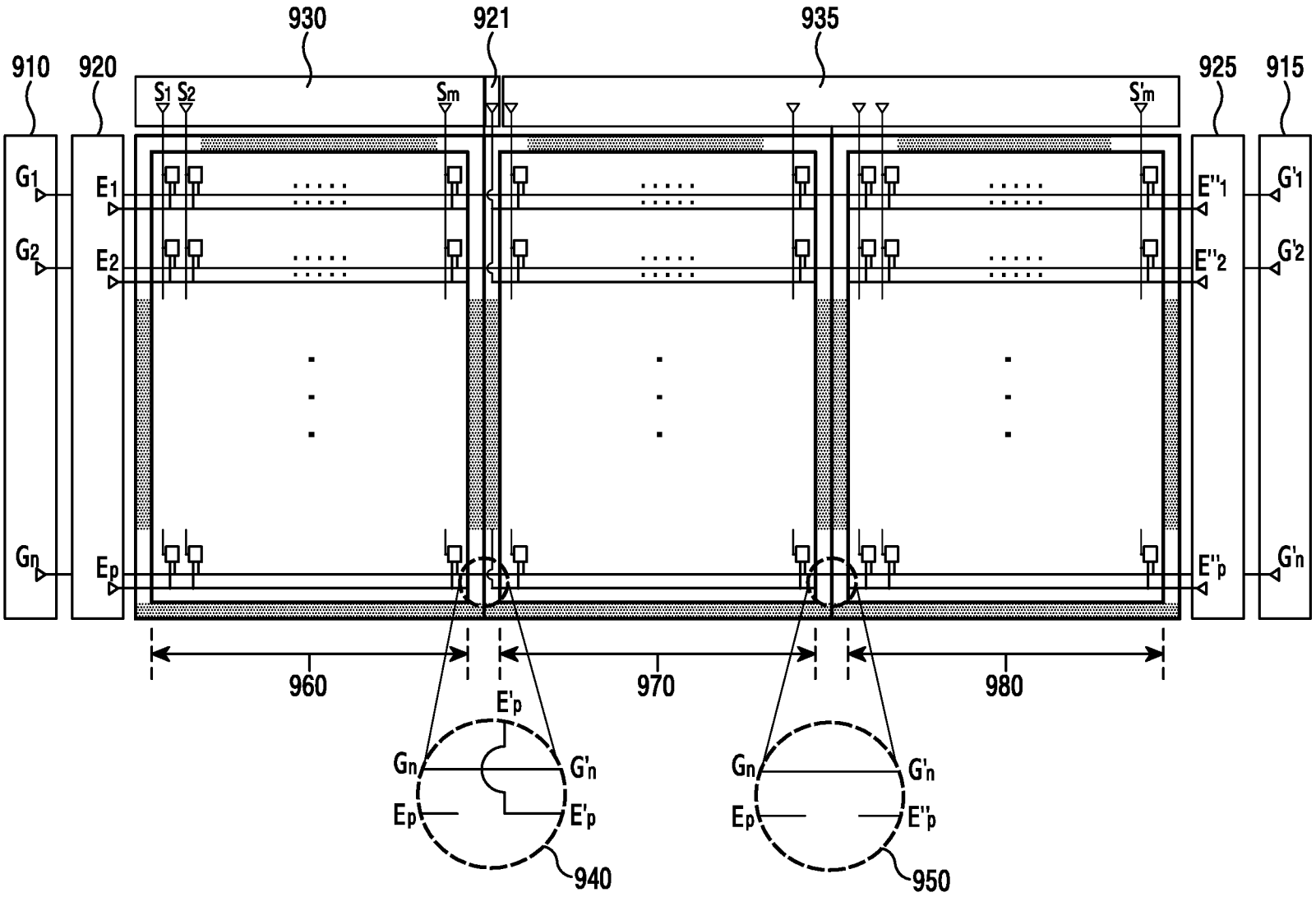

FIG. 9 illustrates an example in which emission drivers are separated according to various embodiments. FIG. 9 may show an example of driver implementation of a case where the electronic device 101 is a flexible display. FIG. 9 illustrates the flexible display in a rectangular shape having a horizontal length longer than a vertical length, and in which the flexible display may be divided into three display areas (e.g., a first display area 960 to a third display area 980). For example, when the flexible display is horizontally placed, the left part may be referred to as a first display area 960, the middle part may be referred to as a second display area 970, and the right part may be referred to as a third display area 980. Alternatively, when the flexible display is vertically placed, the top part may be referred to as the first display area 960, the middle part may be referred to as the second display area 970, and the bottom part may be referred to as the third display area 980.

According to various embodiments, the first display area 960 to the third display area 980 may be folded at the surface corresponding to at least a part of the boundary of each display area. For example, the space between the first display area 960 and the second display area 970 may be folded, and the space between the second display area 970 and the third display area 980 may be folded. The folded part may be formed as a bezel part.

According to various embodiments, a display driver circuit (e.g., the display driver circuit 1 418 and the display driver circuit 2 419) may control the first display area 960 to the third display area 980, based on detection of a bend in at least a part of the boundaries of the first display area 960 to the third display area 980. For example, the display driver circuit may apply an emission control signal to an emission driver 1 920 or an emission driver 2 921, based on detection of a bend in at least a part of the boundaries of the first display area 960 and the second display area 970. For example, the display driver circuit may stop image transmission to a display area covered by bending or folding.

When the display area covered by bending or folding is the first display area 960, the display driver circuit may perform a control not to generate an emission control signal for the emission driver 1 920 of the first display area 960. Further, for a display area other than the display area covered by bending or folding, the display driver circuit may continue image transmission or may change an image transmission scheme. When the display area that is not covered by bending or folding is the second display area 970, the display driver circuit may generate an emission control signal for the emission driver 2 921 of the second display area 970.

According to various embodiments, a sensor (not illustrated) capable of detecting bending or folding may be mounted on a display panel configured to be bent or folded or in a display area (e.g., the first display area 960, the second display area 970, or the third display area 980) adjacent to the display panel. For example, the sensor may detect bending and folding, based on changes in pressure or amount of electric charge.

Referring to FIG. 9, the electronic device 101 may include two gate drivers and two source drivers for controlling the first display area 960 to the third display area 980, and three emission drivers for controlling the first display area 960 to the third display area 980, respectively. According to various embodiments, the electronic device 101 may have three emission drivers for driving the first display area 960 to the third display area 980, respectively, and may have only one gate driver or one source driver. Alternatively, the electronic device 101 may have three gate drivers and three source drivers for controlling the first display area 960 to the third display area 980, respectively.

A gate driver 1 910 and the emission driver 1 920 are for controlling the first display area 960, and may be disposed on the left side of the electronic device 101. Further, a source driver 1 930 for controlling the first display area 960 may be disposed on the upper side of the first display area 960 of the electronic device 101. The gate driver 1 910 may control the gate lines G1-Gn connected to pixels of the display panel 450 to control at least some pixels of the first pixel group of the first display area. The emission driver 1 920 may control the emission lines E1-Ep connected to pixels of the display panel 450 to supply power to at least some pixels of the first pixel group of the first display area. The source driver 1 930 may control the source lines S1-Sm connected to pixels of the display panel 450 to provide data to at least some pixels of the first pixel group of the first display area.

The emission driver 2 921 is for controlling the second display area 970, and may be disposed on the upper side of the display area 970 of the electronic device 101. The emission driver 2 921 may control the emission lines E'1-E'p connected to pixels of the display panel 450 to supply power to some pixels of the second pixel group of the second display area. Further, the source driver 2 935 for controlling the second display area 970 may be disposed on the upper side of the electronic device 101, for example, next to the emission driver 2 921. The source driver 2 935 may control the source lines S'1-S'm connected to pixels of the display panel 450 to provide data to some pixels of the second pixel group of the second display area.

According to various embodiments, the emission driver 1 920 and the emission driver 2 921 may not be connected to each other in terms of hardware (or physically). That is, the emission lines E1-Ep of the emission driver 1 920 and the emission lines E'1-E'p of the emission driver 2 921 are may not be connected in terms of hardware (or physically), and may be separated from each other.

A first line forming area 940 is an enlarged view of driver lines disposed between the first display area 960 and the second display area 970. Referring to the first line forming area 940, it can be seen that gate line "Gn" of the gate driver 1 910 is connected with gate line "G'n" of the gate driver 2 915, while emission line "Ep" of the emission driver 1 920 and emission line "E'p" of the emission driver 2 921 are not connected.

The gate driver 2 915 and the emission driver 3 925 are for controlling the third display area 980, and may be disposed on the right side of the electronic device 101. Further, the source driver 2 935 for controlling the third display area 980 may be disposed on the upper side of the third display area 980 of the electronic device 101. The gate driver 2 915 may control the gate lines G'1-G'n connected to pixels of the display panel 450 to control at least some pixels of the third pixel group of the third display area. The emission driver 3 925 may control the emission lines E"1-E"p connected to pixels of the display panel 450 to supply power to at least some pixels of the third pixel group of the third display area.

According to various embodiments, the emission driver 2 921 and the emission driver 3 925 may not be connected to each other in terms of hardware (physically). That is, the emission lines E'1-E'p of the emission driver 2 921 and the emission lines E"1-E"p of the emission driver 3 925 may not be connected in terms of hardware (physically), and may be separated from each other.

A second line forming area 950 is an enlarged view of driver lines disposed between the second display area 970 and the third display area 980. Referring to the second line forming area 950, it can be seen that gate line "Gn" of the gate driver 1 910 is connected with gate line "G' n" of the gate driver 2 915, while emission line "E'p" of the emission driver 2 921 and emission line "E"p" of the emission driver 3 925 are not connected.

According to various embodiments, when only one of the first display area 960 to the third display area 980 is to be driven, the electronic device 101 may drive only a driver of the display area to be driven. For example, when only the first display area 960 is used, the electronic device 101 may drive the gate driver 1 910, the emission driver 1 920, and the source driver 1 930, and may not drive the emission driver 2 921, the emission driver 3 925, and the source driver 2 935. Alternatively, when only the second display area 970 is to be driven, the electronic device 101 may drive only the gate driver 1 910, the emission driver 2 921, and the source driver 2 935, and may not drive the emission driver 1 920, the emission driver 3 925, and the source driver 1 930. Therefore, when only the drivers corresponding to the second display area 970 are driven, power can be saved compared with a case where all the drivers corresponding to the first display area 960 to the third display area 980 are driven.

Alternatively, when only the third display area 980 is to be driven, the electronic device 101 may drive only the gate driver 2 915, the emission driver 3 925, and the source driver 2 935, and may not drive the emission driver 1 920, the emission driver 2 921, and the source driver 1 930. Therefore, when only the drivers corresponding to the third display area 980, power can be saved compared with a case where all the drivers corresponding to the first display area 960 to the third display area 980 are driven.

Alternatively, when the first display area 960 and the second display area 970 are to be driven, the electronic device 101 may drive the gate driver 1 910, the emission driver 1 920, and the source driver 1 930, and may not drive the gate driver 2 915, the emission driver 2 921, the emission driver 3 925, and the source driver 2 935. Alternatively, when the first display area 960 and the third display area 980 are to be driven, the electronic device 101 may drive the gate driver 1 910, the gate driver 2 915, the emission driver 1 920, the emission driver 3 925, the source driver 1 930, and the source driver 2 935, and may not drive the emission driver 2 921.

Alternatively, when the second display area 970 and the third display area 980 are to be driven, the electronic device 101 may drive the gate driver 1 910, the gate driver 2 915, the emission driver 2 921, the emission driver 3 925, and the source driver 2 935, and may not drive the emission driver 1 920 and the source driver 1 930.

Figure 10:
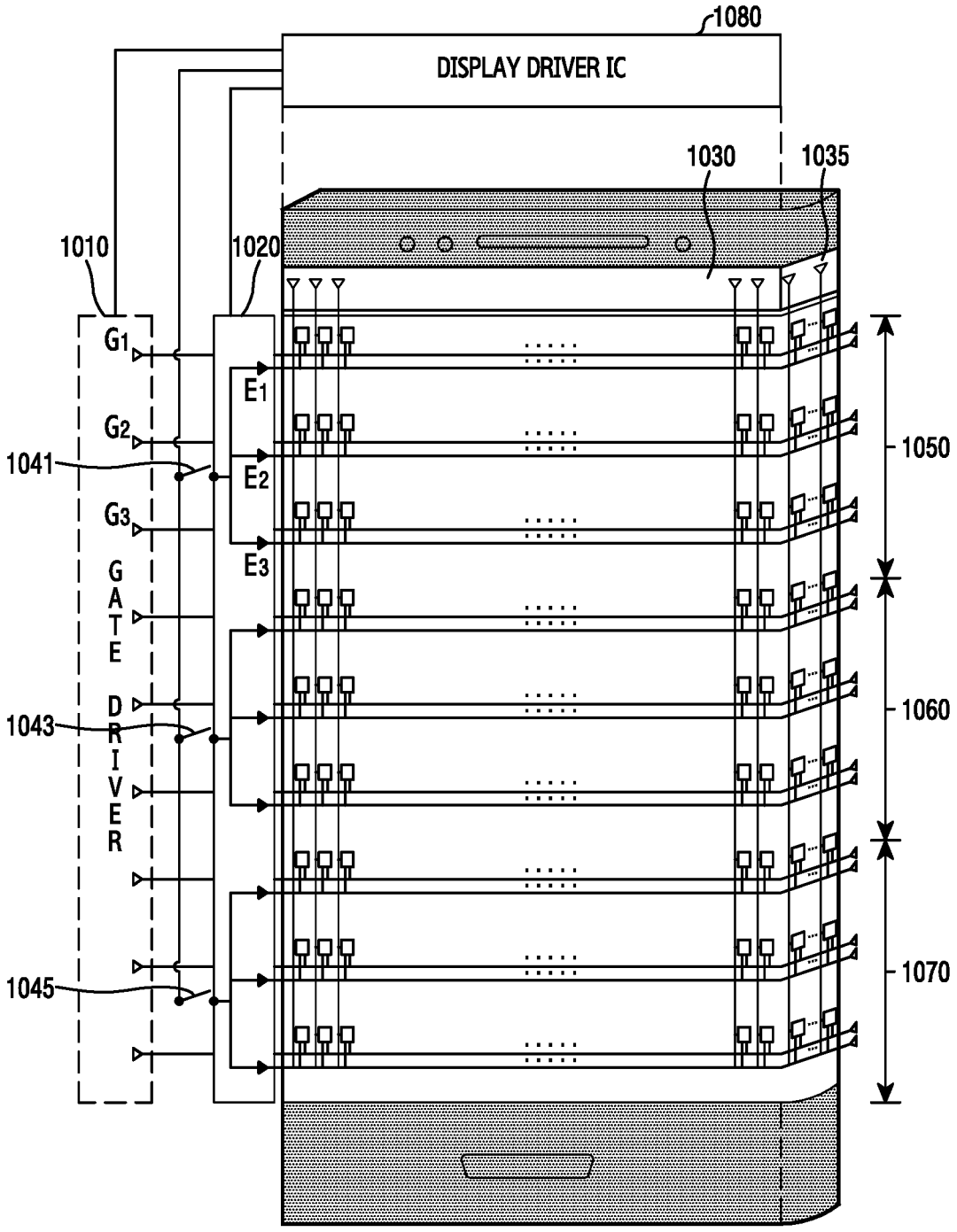

FIG. 10 illustrates an example of including a switch module between drivers according to various embodiments. FIG. 10 may show an example of driver implementation of a case where the electronic device 101 uses an OLED as a display element. Unlike previously described FIG. 5 to FIG. 8, according to FIG. 10, a switch module may individually drive display areas of the electronic device 101 without separating connection lines of drivers.

The electronic device 101 may have a display area divided into three display areas (e.g., a first display area 1050 to a third display area 1070). For example, the top part may be referred to as a first display area 1050, the middle part may be referred to as a second display area 1060, and the bottom part may be referred to as a third display area 1070. In this case, the electronic device 101 may not separate connection lines of drivers, and may arrange switch modules 1041-1045 in display modules, respectively. The switch modules 1041-1045 may be connected to a display driver IC 1080 (e.g., a display driver circuit), and may be driven under control of the display driver IC 1080. Alternatively, although not illustrated, the switch modules 1041-1045 may be connected to the processor 120 of the electronic device 101, and may be driven under control of the processor 120.

A gate driver 1010 and an emission driver 1020 may be disposed on the left side of the electronic device 101, and a source driver 1 1030 may be disposed on the upper side of the electronic device 101. Further, the electronic device 101 may further have a source driver 2 1035 next to the source driver 1 1030. The gate driver 1010, an emission driver 1020, the source driver 1 1030, and the source driver 2 1035 may control the first display area 1050 to the third display area 1070. A first switch module 1041 may drive drivers corresponding to the first display area 1050, a second switch module 1043 may drive drivers corresponding to the second display area 1060, and a third switch module 1045 may drive drivers corresponding to the third display area 1070.

In the drawing, it is illustrated that the gate driver 1010 and the emission driver 1020 are disposed on the left side of the electronic device 101, but the gate driver 1010 and the emission driver 1020 may be disposed on the right side of the electronic device 101. Alternatively, as in FIG. 5, the electronic device 101 may include one gate driver and one emission driver on each of the right and left side of the electronic device 101.

Therefore, when only one of the first display area 1050 to the third display area 1070 is to be driven, the display driver IC 1080 may drive a switch module in the display area to be driven. For example, when only the first display area 1050 is used, the display driver IC 1080 may turn on only the first switch module 1041, and may turn off the second switch module 1043 and the third switch module 1045. In this case, gate lines of the gate driver 1010, emission lines of the emission driver 1020, and source lines of the source driver 1 1030 and source driver 2 1035 with respect to the first display area 1050 may be driven.

Alternatively, when only the second display area 1060 is used, the display driver IC 1080 may turn on only the second switch module 1043, and may turn off the first switch module 1041 and the third switch module 1045. In this case, gate lines of the gate driver 1010, emission lines of the emission driver 1020, and source lines of the source driver 1 1030 and source driver 2 1035 with respect to the second display area 1060 may be driven. Therefore, when only the drivers corresponding to the second display area 1060 are driven, power can be saved compared with a case where all the drivers corresponding to the first display area 1050 to the third display area 1070 are driven.

Alternatively, when only the third display area 1070 is to be driven, the display driver IC 1080 may turn on only the third switch module 1045, and may turn off the first switch module 1041 and the second switch module 1043. In this case, gate lines of the gate driver 1010, emission lines of the emission driver 1020, and source lines of the source driver 1 1030 and source driver 2 1035 with respect to the third display area 1070. Therefore, when only the drivers corresponding to the third display area 1070 are driven, power can be saved compared with a case where all the drivers corresponding to the first display area 1050 to the third display area 1070 are driven.

Alternatively, when only the first display area 1050 and the second display area 1060 are used, the display driver IC 1080 may turn on the first switch module 1041 and the second switch module 1043, and may turn off only the third switch module 1045. In this case, the gate lines of the gate driver 1010, the emission lines of the emission driver 1020, and the source lines of the source driver 1 1030 and source driver 2 1035 with respect to the first display area 1050 and the second display area 1060 may be driven. Therefore, power can be saved compared with a case where all the drivers corresponding to the first display area 1050 to the third display area 1070 are driven.

Alternatively, when only the first display area 1050 and the third display area 1070 are used, the display driver IC 1080 may turn on the first switch module 1041 and the third switch module 1045, and may turn off only the second switch module 1043. In this case, the gate lines of the gate driver 1010, the emission lines of the electronic device 1020, and the source lines of the source driver 1 1030 and source driver 2 1035 with respect to the first display area 1050 and the third display area 1070 may be driven. Therefore, power can be saved compared with a case where all the drivers corresponding to the first display area 1050 to the third display area 1070 are driven.

Alternatively, when only the second display area 1060 and the third display area 1070 are used, the display driver IC 1080 may turn on the second switch module 1043 and the third switch module 1045, and may turn off only the first switch module 1041. In this case, the gate lines of the gate driver 1010, the emission lines of the emission driver 1020, and the source lines of the source driver 1 1030 and source driver 2 1035 with respect to the second display area 1060 and the third display area 1070 may be driven. Therefore, power can be saved compared with a case where all the drivers corresponding to the first display area 1050 to the third display area 1070 are driven.

Figure 11:
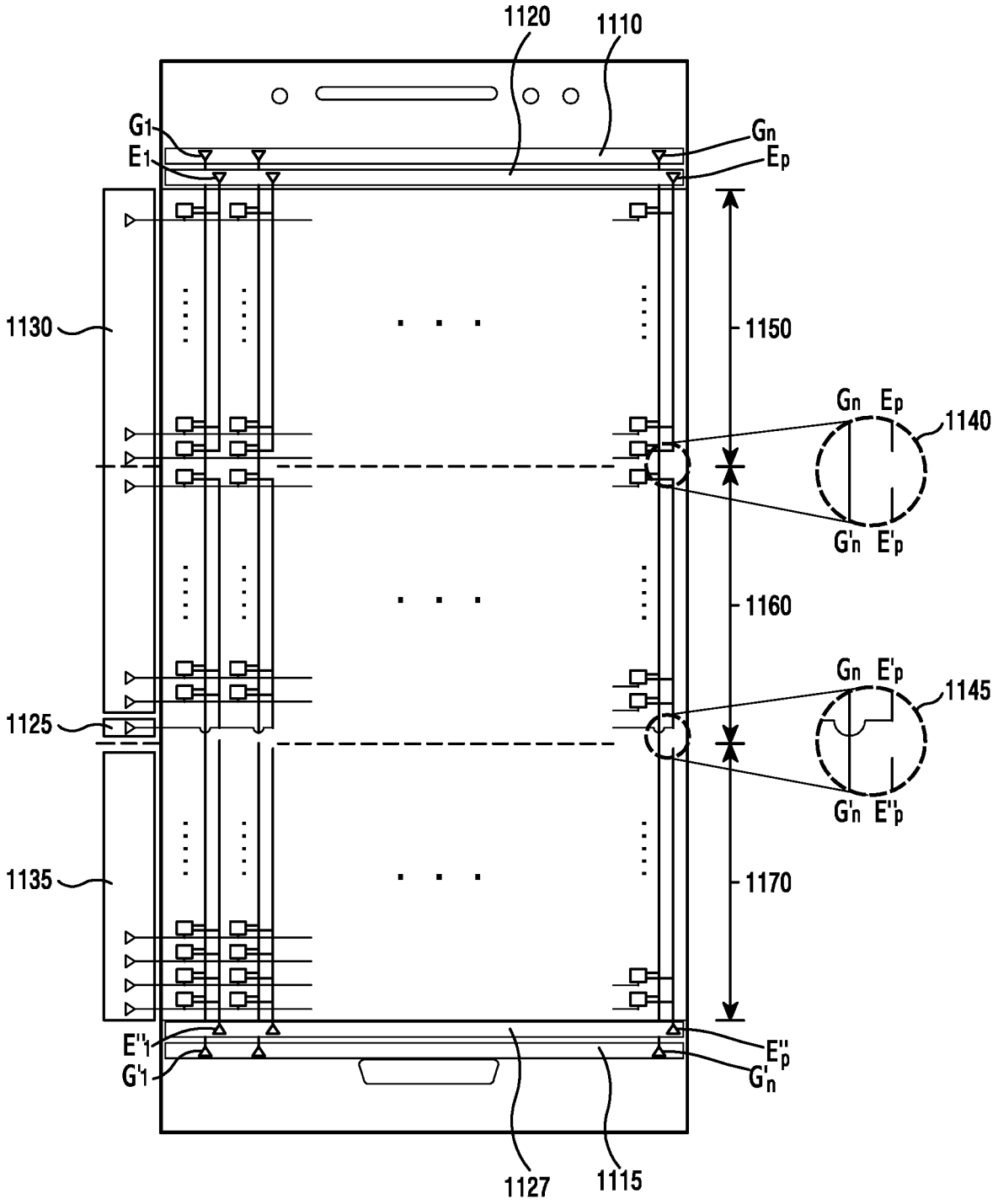

FIG. 11 illustrates an example in which emission drivers are separated according to various embodiments. FIG. 11 may show an example of driver implementation of a case where the electronic device 101 uses OLED as a display element. Unlike FIG. 8, FIG. 11 illustrates an example in which a gate driver and an emission driver are disposed on the upper side and the lower side of the electronic device 101, and a source driver is disposed on the left side of the electronic device. According to various embodiments, the source driver may be disposed on the right side of the electronic device.

Referring to FIG. 11, the electronic device 101 may have a display area divided into three display areas (e.g., a first display area 1150 to a third display area 1170). For example, the top part may be referred to as a first display area 1150, the middle part may be referred to as a second display area 1160, and the bottom part may be referred to as a third display area 1170.

The electronic device 101 may include two gate drivers and two source drivers for controlling the first display area 1150 to the third display area 1170, and three emission drivers for controlling the first display area 1150 to the third display area 1170, respectively. According to various embodiments, the electronic device 101 may have three emission drivers for driving the first display area 1150 to the third display area 1170, respectively, and may have only one gate driver or one source driver. Alternatively, the electronic device 101 may have three gate drivers and three source drivers for controlling the first display area 1150 to the third display area 1170, respectively.

Particularly, the gate driver 1 1110 and the emission driver 1 1120 are for controlling the first display area 1150, and may be disposed on the upper side of the electronic device 101. Further, the source driver 1 1130 for controlling the first display area 1150 may be disclosed on the left side of the first display area 1150 of the electronic device 101. Alternatively, the source driver 1 1130 may be disposed on the right side of the first display area 1150 of the electronic device 101. The gate driver 1 1110 may scan and drive gate lines G1-Gn connected to pixels of the display panel 450. The emission driver 1 1120 may scan and drive emission lines E1-Ep connected to pixels of the display panel 450. The source driver 1 1130 may scan and drive source lines S1-Sm connected to pixels of the display panel 450.

The emission driver 2 1125 is for controlling the second display area 1160, and may be disposed on the left side of the second display area 1160 of the electronic device 101. According to an embodiment, the emission driver 2 1125 may be disposed on the right side of the second display area 1160 of the electronic device 101. The emission driver 2 1125 may scan and drive emission lines E'1-E'p connected to pixels of the display panel 450. Further, the source driver 1 1130 for controlling the second display area 1160 may be disposed on the left side of the electronic device 101, for example, next to the emission driver 2 1125.

According to various embodiments, the emission driver 1 1110 and the emission driver 2 1125 may not be connected to each other in terms of hardware (or physically). That is, the emission lines E1-Ep of the emission driver 1 1110 and the emission lines E'1-E'p of the emission driver 2 1125 may not be connected in terms of hardware (or physically), and may be separated from each other.

A first line forming area 1140 is an enlarged view of driver lines disposed between the first display area 1150 and the second display area 1160. Referring to the first line forming area 1140, it can be seen that gate line "Gn" of the gate driver 1 1110 is connected with gate line "G'n" of the gate driver 2 1115, while emission line "Ep" of the emission driver 1 1110 and emission line "E'p" of the emission driver 2 1125 are not connected.

The gate driver 2 1115 and the emission driver 3 1127 are for controlling the third display area 1170, and may be disposed on the right side (or lower side) of the electronic device 101. Further, the source driver 2 1135 for controlling the third display area 1170 may be disposed on the left side of the third display area 1170 of the electronic device 101. The gate driver 2 1115 may scan and drive gate lines G'1-G'n connected to pixels of the display panel 450. The emission driver 3 1127 may scan and drive emission lines E"1-E"p connected to pixels of the display panel 450.

According to various embodiments, the emission driver 2 1125 and the emission driver 3 1127 may not be connected to each other in terms of hardware (or physically). That is, the emission lines E'1-E'p of the emission driver 2 1125 and the emission lines E" 1-E"p of the emission driver 3 1127 may not be connected in terms of hardware (or physically), and may be separated from each other.

A second line forming area 1145 is an enlarged view of driver lines disposed between the second display area 1160 and the third display area 1170. Referring to the second line forming area 1145, it can be seen that gate line "Gn" of the gate driver 1 1110 is connected with gate line "G'n" of the gate driver 2 1115, while emission line "E'p" of the emission driver 2 1125 and emission line "E"p" of the emission driver 3 1127 are not connected.

According to various embodiments, when only one of the first display area 1150 to the third display area 1170 of the electronic device 101 is to be driven, the electronic device 101 may drive only a driver of the display area to be driven. For example, when only the first display area 1150 is used, the electronic device 101 may drive the gate driver 1 1110, the emission driver 1 1120, and the source driver 1 1130, and may not drive the gate driver 2 1115, the emission driver 2 1125, the emission driver 3 1127, and the source driver 2 1135.

Alternatively, when only the second display area 1160 is to be driven, the electronic device 101 may drive only the gate driver 1 1110, the emission driver 2 1125, and the source driver 1 1130, and may not drive the emission driver 1 1120, the emission driver 3 1127, and the source driver 2 1135. Therefore, when only the drivers corresponding to the second display area 1160 are driven, power can be saved compared with a case where all the drivers corresponding to the first display area 1150 to the third display area 1170 are driven. Alternatively, when only the third display area 1170 is to be driven, the electronic device 101 may drive only the gate driver 2 1115, the emission driver 3 1127, and the source driver 2 1135, and may not drive the gate driver 1 1110, the emission driver 1 1120, the emission driver 2 1125, and the source driver 1 1130. Therefore, when only the drivers corresponding to the third display area 1170 are driven, power can be saved compared with a case where all the drivers corresponding to the first display area 1150 to the third display area 1170 are driven.

Alternatively, when the first display area 1150 and the second display area 1160 are to be driven, the electronic device 101 may drive the gate driver 1 1110, the emission driver 1 1120, the emission driver 2 1125, and the source driver 1 1130, and may not drive the gate driver 2 1115, the emission driver 3 1127, and the source driver 2 1135.

Alternatively, when the first display area 1150 and the third display area 1170 are to be driven, the electronic device 101 may drive the gate driver 1 1110, the gate driver 2 1115, the emission driver 1 1120, the emission driver 3 1127, the source driver 1 1130, and the source driver 2 1135, and may not drive the emission driver 2 1125.

Alternatively, when the second display area 1150 and the third display area 1170 are to be driven, the electronic device 101 may drive the gate driver 1 1110, the gate driver 2 1115, the emission driver 2 1125, the emission driver 3 1127, the source driver 1 1130, and the source driver 2 1135, and may not drive the emission driver 1 1120.

A display panel according to various embodiments may include: a first pixel group and a second pixel group for converting an electrical signal to an optical signal; a first emission line for transferring power supplied from the outside to the first pixel group; and a second emission line for transferring the power to the second pixel group, wherein the first emission line and the second emission line may be electrically separated from each other.

The first emission line may be configured to receive power supplied from a first emission control circuit included in an external display driver circuit, and the second emission line may be configured to receive power supplied from a second emission control circuit included in the external display driver circuit. At least one first gate line and at least one second gate line for connection to the gate control circuit may be further included, wherein the first gate line is electrically connected to the first pixel group, and the second gate line is electrically connected to the second pixel group.

The at least one first gate line and the at least one second gate line may be electrically separated from each other.

A display device according to various embodiments may include: a display panel including a first display area corresponding to a first pixel group, and a second display area corresponding to a second pixel group; and a display driver circuit for controlling the display panel, wherein the display driver circuit includes a first emission control circuit for controlling power supply to at least some pixels of the first pixel group, and a second emission control circuit for controlling power supply to at least some pixels of the second pixel group.

The first emission control circuit and the second emission control circuit may be configured to be controllable independently of each other.

A first gate line for controlling the at least some pixels of the first pixel group and a second gate line for controlling the at least some pixels of the second pixel group may be further included.

The display driver circuit may be configured to control the first gate line and the second gate line independently of each other.

The display driver circuit may be configured to transfer an emission control signal to the first emission control circuit or the second emission control circuit, based on detection of a bend in at least a part of the boundaries of the first display area and the second display area.

The display panel may further include a first emission line for supplying power to the first display area and the first emission control circuit, and a second emission line for supplying power to the second display area and the second emission control circuit. The first emission line and the second emission lime may be electrically separated from each other at a point corresponding to an area in which the display panel is folded or forms a curved surface.

An electronic device according to various embodiments may include a processor, a communication module, and a display functionally connected with the communication module, wherein the display includes: a display panel including a first display area corresponding to a first pixel group, and a second display area corresponding to a second pixel group; and a display driver circuit for controlling the display panel, wherein the display driver circuit includes a first emission control circuit for controlling power supply to at least some pixels of the first pixel group, and a second emission control circuit for controlling power supply to at least some pixels of the second pixel group.

The first emission control circuit and the second emission control circuit may be configured to be controllable independently of each other.

A first gate line for controlling the at least some pixels of the first pixel group and a second gate line for controlling the at least some pixels of the second pixel group may be further included.

The display driver circuit may be configured to control the first gate line and the second gate line independently of each other.

The display may form a curved surface on a surface corresponding to at least a part of the boundaries of the first display area and the second display area.

The display may be configured to be folded on the surface corresponding to at least the part of the boundaries of the first display area and the second display area.

The display driver circuit may apply an emission control signal to the first emission control circuit and the second emission control circuit, based on detection of a bend in at least a part of the boundaries of the first display area and the second display area.

The display panel further includes a first emission line for supplying power to the first display area and the first emission control circuit, and a second emission line for supplying power to the second display area and the second emission control circuit, wherein the first emission line and the second emission line may be electrically separated from each other at a point corresponding to an area in which the display panel is folded or forms a curved surface.

Figure 12:
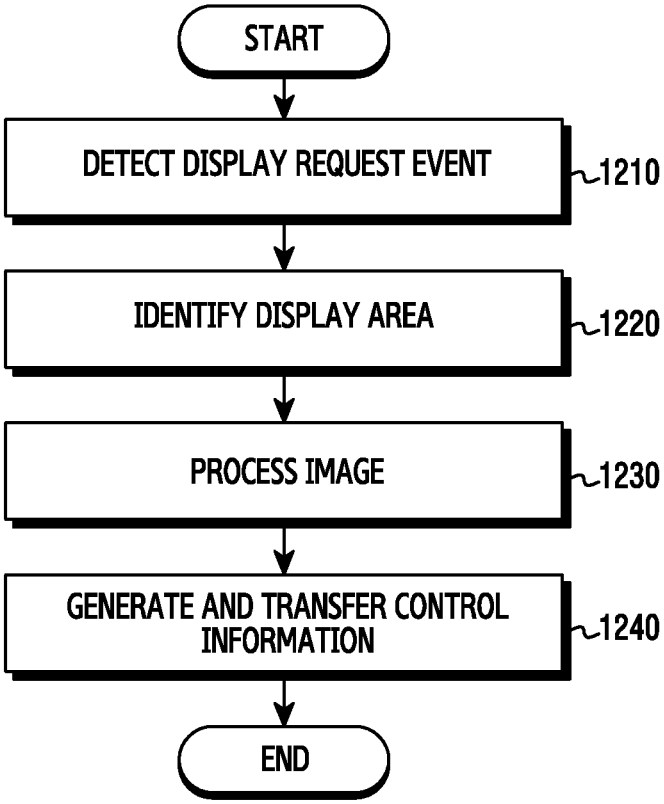
FIG. 12 is a flowchart illustrating an operation method of an electronic device according to various embodiments.

FIG. 12 is a flowchart illustrating an operation method of an electronic device according to various embodiments.

Referring to FIG. 12, the electronic device 101 may include the display 160 including two display areas (e.g., the first display area 403 and the second display area 404), and may have drivers that drive the first display area 403 and the second display area 404, respectively. In this case, the two drivers may be connected or disconnected in terms of hardware.

In operation 1210, the processor 120 may detect a display request event. The display request event may be detection of a content output request made by a user, or may be detection of the turning on of the display 160 from a turn-off state thereof.

In operation 1220, the processor 120 may identify a display area corresponding to the display request event. For example, the processor 120 may identify whether the display request event relates to all display areas (e.g., the first display area 403 and the second display area 404) or relates to a single display area (e.g., the first display area 403 or the second display area 404).

In operation 1230, the processor 120 may process an image for displaying video data in the identified display area. For example, in the electronic device 101, display configuration information may be configured on the basis of a user configuration or an electronic device 101 configuration. The display configuration information may include a condition of using display area division, a display area use configuration (e.g., using all display areas, using only the first display area, using only the second display area, etc.), and the like. Additionally or alternatively, the electronic device 101 may have different image types (or categories) to be displayed by using all display areas or using a single display area. The electronic device 101 may perform, for example, by using the processor 120, image processing when using all display areas or image processing when using a single display area, differently on the basis of the display configuration information.

In operation 1240, the processor 120 may generate control information relating to the image-processed image data, and may transfer the control information to the display device 440. The control information may be a display area, resolution, etc. relating to the image data. For example, when the display area corresponds to all display areas, the control information may include information relating to display drivers for driving all display areas. Alternatively, when the display area corresponds to a single display area, the control information may include information relating to display drivers for driving the single display area.

Referring to FIG. 5, when only the second display area is to be driven, the processor 120 may generate control information for driving of the gate driver 2 515, the emission driver 2 525, and the source driver 2 535. When only the first display area is to be driven, the processor 120 may generate control information for driving of the gate driver 1 510, the emission driver 1 520, and the source driver 1 530.

Figure 13:
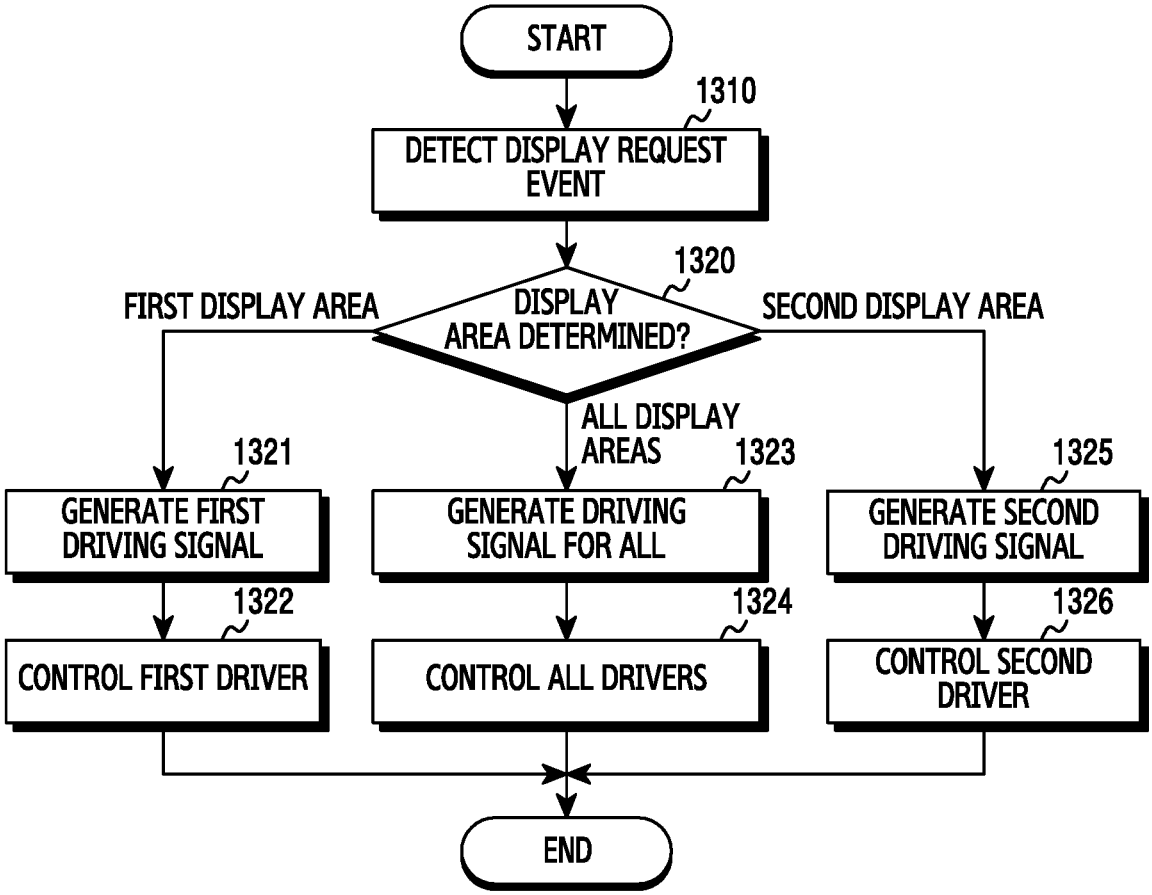
FIG. 13 is a flowchart illustrating an operation method of a display device according to various embodiments.

FIG. 13 is a flowchart illustrating an operation method of a display device according to various embodiments.

Referring to FIG. 13, in operation 1310, the display device 440 (e.g., a display driver circuit) may detect a display request event. The display request event may be detection of a content output request made by a user, or may be detection of the turning on of the display 160 from a turn-off state thereof. The display device 440 may receive the display request event transferred from the processor 120 of the electronic device 101. Alternatively, the display device 440 may receive control information corresponding to the display request event from the processor 120.

In operation 1320, the display device 440 may determine a display area corresponding to the display request event. For example, when the electronic device 101 includes two display areas (e.g., the first display area 403 and the second display area 404), the display device 440 may determine whether the display request event relates to all display areas (e.g., the first display area 403 and the second display area 404) or relates to a single display area.

According to various embodiments, the display device 440 may display at least a part of the content through the first display area 403 by using a first driver (e.g., a first emission control circuit), and may refrain from supplying power to at least some pixels of the second display area 404 by using a second driver (e.g., a second emission control circuit). The display device 440 may not supply power to the at least some pixels of the second display area 404 while at least some pixels of the first display area 403 are displaying the content.

The display device 440 may perform operation 1323 when the display request event corresponds to all display areas, may perform operation 1321 when the display request event corresponds to the first display area, and may perform operation 1325 when the display request event corresponds to the second display area. When the display request event corresponds to the first display area, the display device 440 may generate a first driving signal, in operation 1321. The first driving signal is to drive the first driver for the first display area. For example, when the electronic device 101 includes an OLED display, the first driver may include at least one of a gate driver, an emission driver, and a source driver. Alternatively, when the electronic device 101 includes a TFT display, the first driver may include at least one of a gate driver and a source driver.

In operation 1322, the display device 440 may control the first driver. The display device 440 may control the first driver for the first display area to display video data in the first display area. For example, referring to FIG. 4B, the display device 440 may drive the gate driver 1 410, the emission driver 1 420, and the source driver 1 430, which are connected to the first display area, to display video data. For example, the display device 440 may supply power from the emission driver 1 420 to the first pixel group to display at least a part of the content through the first display area.

When the display request event corresponds to the second display area, the display device 440 may generate a second driving signal, in operation 1325. The second driving signal is to drive the second driver for the second display area. For example, when the electronic device 101 includes an OLED display, the second driver may include at least one of a gate driver, an emission driver, and a source driver. Alternatively, when the electronic device 101 includes a TFT display, the second driver may include at least one of a gate driver and a source driver.

In operation 1326, the display device 440 may control the second driver. The display device 440 may control the second driver for the second display area to display video data in the second display area. For example, referring to FIG. 4C, the display device 440 may drive the gate driver 2 415, the emission driver 2 415, and the source driver 2 435, which are connected to the second display area, to display video data in the second display area. For example, the display device 440 may supply power from the emission driver 2 425 to the second pixel group to display at least a part of the content through the second display area.

When the display request event corresponds to all display areas, the display device 440 may generate a driving signal for all, in operation 1323. The driving signal for all may be to drive all the first driver and the second driver.

In operation 1324, the display device 440 may control all drivers. The display device 440 may control the first driver and the second driver to display video data in the all display areas. For example, referring to FIG. 4B and FIG. 4C, the display device 440 may drive the gate driver 1 410, the emission driver 1 420, and the source driver 1 430, which are connected to the first display area, and may drive the gate driver 2 415, the emission driver 2 425, and the source driver 2 435, which are connected to the second display area, to display video data in the all display areas. For example, the display device 440 may supply power from the emission driver 1 420 to the first pixel group to display at least a part of the content through the first display area, and may supply power from the emission driver 2 425 to the second pixel group to display at least a part of the content through the second display area.

According to various embodiments, a display control method of an electronic device including a display device that includes a display driver circuit including a first emission control circuit for controlling power supply to at least some pixels of a first display area corresponding to a first pixel group of a display panel, and a second emission control circuit that controls power supply to at least some pixels of a second display area corresponding to a second pixel group of the display panel, and can be controlled independently of the first emission control circuit, may include: receiving a request for outputting a content; at least on the basis of the request; displaying at least a part of the content through the first display area by using the first emission control circuit; at least on the basis of displaying of at least the part of the content, refraining from supplying power to the at least some pixels of the second display area, by using the second emission control circuit.

The display control method may further include determining of the content to be output, in response to detection of a bend in at least a part of the boundaries of the first display area and the second display area. The electronic device may further include a first gate line electrically connected to the first display area, and a second gate line electrically connected to the second display area, wherein the display driver circuit is capable of controlling the first gate line and the second gate line independently of each other, and the displaying includes: displaying at least a part of the content through the first display area; and at least on the basis of displaying of at least the part of the content, refraining from supplying a gate signal to the at least some pixels of the second display area, by using the second gate line.

The displaying may include supplying power from the first emission control circuit to the first pixel group to display at least the part of the content through the first display area, or supplying power from the second emission control circuit to the second pixel group to display at least the part of the content through the second display area.

The display control method may further include transferring an emission control signal to the first emission control circuit or the second emission control circuit, on the basis of detection of a bend in at least a part of the boundaries of the first display area and the second display area.

According to various embodiments, a computer-readable recording medium may include a program for: receiving a request for outputting a content; at least on the basis of the request, displaying at least a part of the content through the first display area by using the first emission control circuit; and at least on the basis of displaying of at least the part of the content, refraining from supplying power to the at least some pixels of the second display area, by using the second emission control circuit.

The computer-readable recording medium may include the program for determining the content to be output, in response to detection of a bend in at least a part of the boundaries of the first display area and the second display area.

The computer-readable recording medium may include the program wherein the displaying may include: displaying at least a part of the content through the first display area; and at least on the basis of displaying of at least the part of the content, refraining from supplying a gate signal to the at least some pixels of the second display area, by using the second gate line.

The computer-readable recording medium may include the program wherein the displaying may include supplying power from the first emission control circuit to the first pixel group to display at least the part of the content through the first display area, or supplying power from the second emission control circuit to the second pixel group to display at least the part of the content through the second display area.

The computer-readable recording medium may include the program for transferring an emission control signal to the first emission control circuit or the second emission control circuit, on the basis of detection of a bend in at least a part of the boundaries of the first display area and the second display area.

The term "module" as used herein includes a unit that includes hardware, software, or firmware and may be used interchangeably with the term, for example, "logic", "logical block, or "circuit. The "module" may be an integrated part, or a minimum unit for performing one or more functions or a part thereof. The "module" may be mechanically or electronically implemented and may include, for example, an Application-Specific Integrated Circuit (ASIC) chip, a Field-Programmable Gate Arrays (FPGA), or a programmable-logic device, which has been known or are to be developed in the future, for performing certain operations.

At least some of devices (e.g., modules or functions thereof) or methods (e.g., operations) according to various embodiments may be implemented by an instruction which is stored a computer-readable storage medium (e.g., the memory 130) in the form of a program module. The instruction, when executed by a processor (e.g., the processor 120), may cause the one or more processors to execute the function corresponding to the instruction. The computer-readable storage medium may include a hard disk, a floppy disk, a magnetic medium (e.g., a magnetic tape), an Optical Media (e.g., CD-ROM, DVD), a Magneto-Optical Media (e.g., a floptical disk), an inner memory, etc. The instruction may include a code which is made by a compiler or a code which may be executed by an interpreter. The programming module according to the present disclosure may include one or more of the aforementioned components or may further include other additional components, or some of the aforementioned components may be omitted. Operations performed by a module, a programming module, or other elements according to various embodiments may be executed sequentially, in parallel, repeatedly, or in a heuristic manner. At least some operations may be executed according to another sequence, may be omitted, or may further include other operations.

The embodiments disclosed in the present specifications and drawings are provided merely to readily describe and help a thorough understanding of the present disclosure but are not intended to limit the scope of the present disclosure. Therefore, it should be construed that, in addition to the embodiments disclosed herein, all modifications and changes or modified and changed forms derived from the technical idea of the present disclosure fall within the scope of the present disclosure.

The invention claimed is:

1. A display device comprising:

a display panel comprising:

a first pixel group corresponding to a first display area of the display panel;

a second pixel group corresponding to a second display area of the display panel;

a plurality of first emission lines electrically respectively connected to a plurality of first sets of pixels of the first pixel group; and a plurality of second emission lines electrically respectively connected to a plurality of second sets of pixels of the second pixel group, wherein each of the first sets of pixels and each of the second sets of pixels are arranged on a same line, and wherein each of the plurality of first emission lines and each of the plurality of second emission lines are electrically opened from each other;

a display driver circuit electrically connected to the display panel; and at least one processor operatively coupled to the display panel and the display driver circuit, wherein the processor is configured to:

detect an event for displaying a content only in the first display area; and based on the detection, control the display driver circuit to transfer a signal to the first pixel group through the first emission lines to emit light and refrain from emitting light by the second pixel group, and wherein the second display area is disposed laterally extended from the first display area seamlessly.

2. The display device of claim 1, wherein at least one processor is further configured to:

in order to transfer the signal to the first pixel group to emit the light, control the display driver circuit to transfer an emission control signal for turning on a transistor connected to a diode in the first pixel group; and in order to refrain from emitting the light by the second pixel group, control the display driver circuit to turn off a transistor connected to a diode in the second pixel group.

3. The display device of claim 1, wherein at least portion of a front surface of the display device is formed by the first display area, and wherein at least portion of a side surface of the display device is formed by the second display area.

4. The display device of claim 1, wherein the display panel further comprises a first gate line for controlling at least some pixels of the first pixel group, and a second gate line for controlling at least some pixels of the second pixel group.

5. The display device of claim 4, wherein the display driver circuit is configured to control the first gate line and the second gate line independently of each other.

6. The display device of claim 4, wherein the first gate line and the second gate line are electrically connected to each other.

7. The display device of claim 1, wherein the display driver circuit includes:

a first emission control circuit for controlling power supplied to the first pixel group; and a second emission control circuit for controlling power supplied to the second pixel group, wherein the first emission control circuit and the second emission control circuit are configured to be controllable independently of each other.

8. The display device of claim 7, wherein the first emission control circuit and the second emission control circuit are disposed on opposing lateral sides of the display panel.

9. The display device of claim 7, wherein each of the plurality of the first emission lines and each of the plurality of the second emission lines correspond to a same row of a pixel matrix of the display panel.

10. The display device of claim 7, wherein the at least one processor is further configured to detect another event for displaying a content in the first display area and the second display area, and based on the detection of the other event for displaying the content in the first display area and the second display area, control the display driver circuit to transfer a first signal to the first pixel group through the plurality of the first emission lines to emit light and transfer a second signal to the second pixel group through the plurality of the second emission lines to emit light.

11. The display device of claim 7, wherein the display driver circuit is configured to transfer an emission control signal to the first emission control circuit or the second emission control circuit on the basis of detection of a bend in at least a part of boundaries of the first display area and the second display area.

12. The display device of claim 11, wherein the first emission line and the second emission line are electrically separated from each other at a point corresponding to an area in which the display panel is folded or forms a curved surface.

13. An electronic device comprising:

a communication module; and a display functionally connected with the communication module, wherein the display comprises:

a display panel comprising:

a plurality of first pixel groups corresponding to a first display area of the display panel;

a plurality of second pixel groups corresponding to a second display area of the display panel;

a plurality of first emission lines configured to transfer power to each of the plurality of first pixel groups; and a plurality of second emission lines configured to transfer the power to each of the plurality of second pixel groups; and a display driver circuit for controlling the display panel; and a processor operatively coupled to the communication module and the display, wherein the processor is configured to detect a request for displaying a content only in the first display area, wherein the display is configured to:

based on the detection, control the display driver circuit to transfer the power to the plurality of first pixel groups through the plurality of first emission lines and control the display driver circuit to refrain from transferring the power to the plurality of second pixel groups through the plurality of second emission lines, and wherein the second display area is disposed laterally extended from the first display area seamlessly.

14. The electronic device of claim 13, wherein the display driver circuit includes a first emission control circuit for controlling power supply to the first pixel groups and a second emission control circuit for controlling power supply to the second pixel groups, wherein the first emission control circuit and the second emission control circuit are configured to be controllable independently of each other.

15. The electronic device of claim 13, wherein the first emission lines and the second emission lines are electrically separated at a point corresponding to an area of display panel between the first display area and the second display area.

16. The electronic device of claim 13, wherein the display driver circuit includes a first emission control circuit electrically connected to the plurality of first pixel groups and a second emission control circuit electrically connected to the plurality of second pixel groups, and wherein the first and the second emission control circuits are disposed on opposing lateral sides of the display panel.

17. The electronic device of claim 13, wherein each of the first emission lines is electrically connected to each of the plurality of first pixel groups, wherein each of the second emission lines is electrically connected to each of the plurality of second pixel groups, wherein each of the plurality of first pixel groups and each of the plurality of second pixel groups correspond to a same row of a pixel matrix of the display panel, and wherein each of the first emission lines and each of the second emission lines correspond to the same row of the pixel matrix.

18. The electronic device of claim 13, further comprising a plurality of first gate lines for controlling each of the plurality of first pixel groups, and a plurality of second gate lines for controlling each of the plurality of second pixel groups.

19. The electronic device of claim 18, wherein the display driver circuit is configured to control the first gate lines and the second gate lines independently of each other.

* * * * *